US012528660B2

(12) United States Patent
Nakai

(10) Patent No.: US 12,528,660 B2
(45) Date of Patent: Jan. 20, 2026

(54) SHEET CONVEYING DEVICE, AUTOMATIC DOCUMENT FEEDER, AND IMAGE FORMING APPARATUS

(71) Applicant: Yusuke Nakai, Kanagawa (JP)

(72) Inventor: Yusuke Nakai, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 203 days.

(21) Appl. No.: 18/236,948

(22) Filed: Aug. 23, 2023

(65) Prior Publication Data

US 2024/0067484 A1 Feb. 29, 2024

(30) Foreign Application Priority Data

Aug. 24, 2022 (JP) ..... 2022-133652
Jun. 14, 2023 (JP) ..... 2023-098059

(51) Int. Cl.
*B65H 7/12* (2006.01)
*B65H 7/06* (2006.01)
*B65H 26/02* (2006.01)

(52) U.S. Cl.
CPC ..... *B65H 26/02* (2013.01); *B65H 2553/30* (2013.01); *B65H 2601/10* (2013.01); *B65H 2601/255* (2013.01)

(58) Field of Classification Search
CPC .. B65H 2553/30; B65H 2515/82; B65H 7/06; B65H 7/12; B65H 7/02; B65H 7/18; B65H 7/20; B65H 2513/52; G03G 15/70
See application file for complete search history.

(56) References Cited

U.S. PATENT DOCUMENTS 8,991,820 B2 * 3/2015 Hongo ..... B65H 5/00 271/265.01
2024/0059516 A1 * 2/2024 Wada ..... G03G 21/00

FOREIGN PATENT DOCUMENTS

JP 2003-141306 A 5/2003
JP 2019-137549 A 8/2019
JP 2020-154520 A 9/2020
JP 2021-181376 A 11/2021

* cited by examiner

*Primary Examiner* — Luis A Gonzalez
(74) *Attorney, Agent, or Firm* — XSENSUS LLP

(57) ABSTRACT

A sheet conveying device includes a conveyor, a sound collector, and circuitry. The conveyor conveys a sheet. The sound collector collects an operating sound when the sheet is conveyed. The circuitry is to extract a feature amount of the operating sound collected by the sound collector, select, among multiple sets of index data serving as index to determine whether an abnormal conveyance of the sheet is to be occurred, a set of index data corresponding to a conveyance condition of the sheet, and determine whether the abnormal conveyance of the sheet is to be occurred based on the feature amount and the set of index data selected from the multiple sets of index data.

20 Claims, 9 Drawing Sheets

SHEET CONVEYING DEVICE, AUTOMATIC DOCUMENT FEEDER, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2022-133652, filed on Aug. 24, 2022, and 2023-098059, filed on Jun. 14, 2023, in the Japan Patent Office, the entire disclosure of each of which is hereby incorporated by reference herein.

BACKGROUND

Technical Field

Embodiments of the present disclosure relate to a sheet conveying device, an automatic document feeder incorporating the sheet conveying device, and an image forming apparatus incorporating the sheet conveying device.

Background Art

Various sheet conveying devices are known that include a conveyor to convey a sheet, a sound collector to collect an operating sound generated when the sheet is conveyed, a feature extraction unit to extract the feature of the operating sounds collected by the sound collector, and an abnormal conveyance determiner to determine whether abnormal conveyance occurs based on the feature.

In order to forestall occurrence abnormal conveyance, a sheet conveying device related in the art gives the feature quantitatively expressing the features of the operating sounds collected by the sound collector, to a support vector machine, and classifies the features into three classes that are normal conveyance, document deformation, and document slippage in conveyance, through use of machine learning as index data. When the features are classified into the document slippage and the document deformation by the support vector machine, it is determined that the conveyance is abnormal conveyance. When the features are classified into the document slippage, the conveyor is heated. When the features are classified into the document deformation, the document feeder cover is opened.

SUMMARY

Embodiments of the present disclosure described herein provide a novel sheet conveying device including a conveyor, a sound collector, and circuitry. The conveyor conveys a sheet. The sound collector collects an operating sound when the sheet is conveyed. The circuitry is to extract a feature amount of the operating sound collected by the sound collector, select, among multiple sets of index data serving as index to determine whether an abnormal conveyance of the sheet is to be occurred, a set of index data corresponding to a conveyance condition of the sheet, and determine whether the abnormal conveyance of the sheet is to be occurred based on the feature amount and the set of index data selected from the multiple sets of index data.

Further, embodiments of the present disclosure described herein provide an image forming apparatus including the above-described sheet conveying device, a sheet feeder, and an image former. The sheet conveying device automatically conveys an original document. The sheet feeder feeds a blank sheet. The image former forms an image, based on image data of the original document, on the blank sheet fed by the sheet feeder.

Further, embodiments of the present disclosure described herein provide an automatic document feeder including the above-described sheet conveying device and an image reader. The sheet conveying device automatically conveys an original document. The image reader reads image data of the original document conveyed from the sheet conveying device.

Further, embodiments of the present disclosure described herein provide an image forming apparatus including the above-described automatic document feeder, a sheet feeder, and an image former. The automatic document feeder automatically conveys an original document. The sheet feeder feeds a blank sheet. The image former forms an image, based on image data of the original document, on the blank sheet fed by the sheet feeder.

BRIEF DESCRIPTION OF THE SEVERAL VIEWS OF THE DRAWINGS

Exemplary embodiments of this disclosure will be described in detail based on the following figures, wherein.

Figure 1:
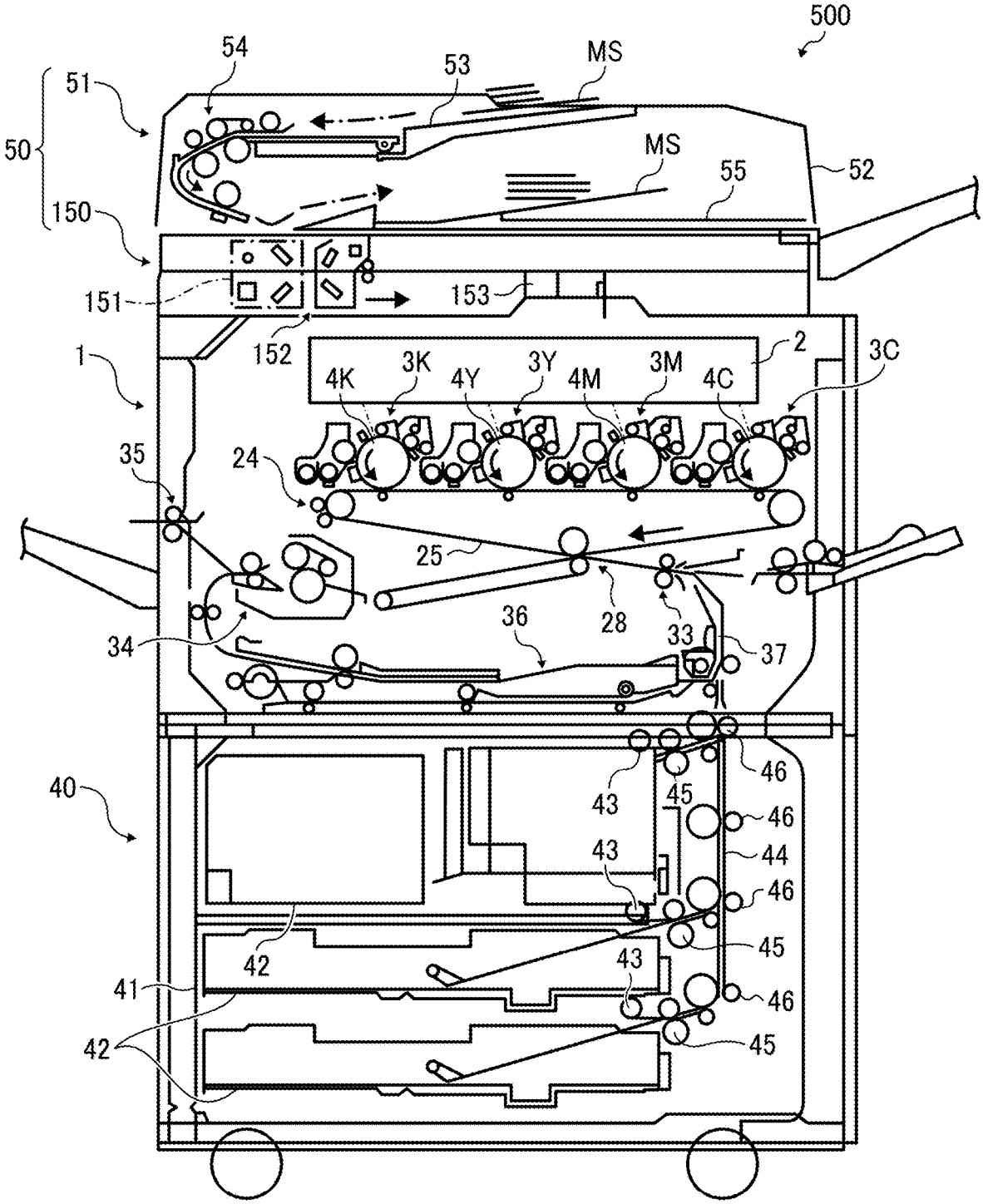
FIG. 1 is a schematic diagram illustrating an inner configuration of a copier as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. As used herein, the term "connected/coupled" includes both direct connections and connections in which there are one or more intermediate connecting elements. Like numbers refer to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Embodiments of the present disclosure are described below in detail with reference to the drawings. It is to be understood that an identical or similar reference character is given to identical or corresponding parts throughout the drawings, and redundant descriptions are omitted or simplified below.

Descriptions are given of an electrophotographic image forming apparatus for forming images by electrophotography. In the present disclosure, the electrophotographic image forming apparatus is referred to as an image forming apparatus or a copier.

A description is now given of the basic configuration of a copier as an image forming apparatus according to the present embodiment.

FIG. 1 is a diagram illustrating a schematic configuration of a copier 500 serving as an image forming apparatus according to the present embodiment.

The copier 500 includes an image forming device 1, a blank sheet feeding device 40, and a document reading device 50. The document reading device 50 includes a scanner 150 fixedly mounted on the image forming device 1 and an automatic document feeder (ADF) 51 serving as a document feeder supported by the scanner 150.

The blank sheet feeding device 40 includes a sheet bank 41, sheet feed rollers 43, and sheet separation roller pairs 45. The sheet bank 41 includes multiple sheet trays 42 (three sheet trays 42 in the present embodiment) disposed in a multistage manner. Each of the sheet feed rollers 43 picks up a transfer sheet from the corresponding sheet trays 42. Each of the sheet separation roller pairs 45 separates the transfer sheet from the corresponding sheet tray 42 and feeds the transfer sheet to a sheet conveyance passage 44. The blank sheet feeding device 40 further includes multiple sheet conveyance rollers 46 each of which conveys the transfer sheet toward a sheet conveyance passage 37. Thus, the blank sheet feeding device 40 feeds the transfer sheet stacked on the corresponding sheet tray 42 to the sheet conveyance passage 37 in the image forming device 1.

Figure 2:
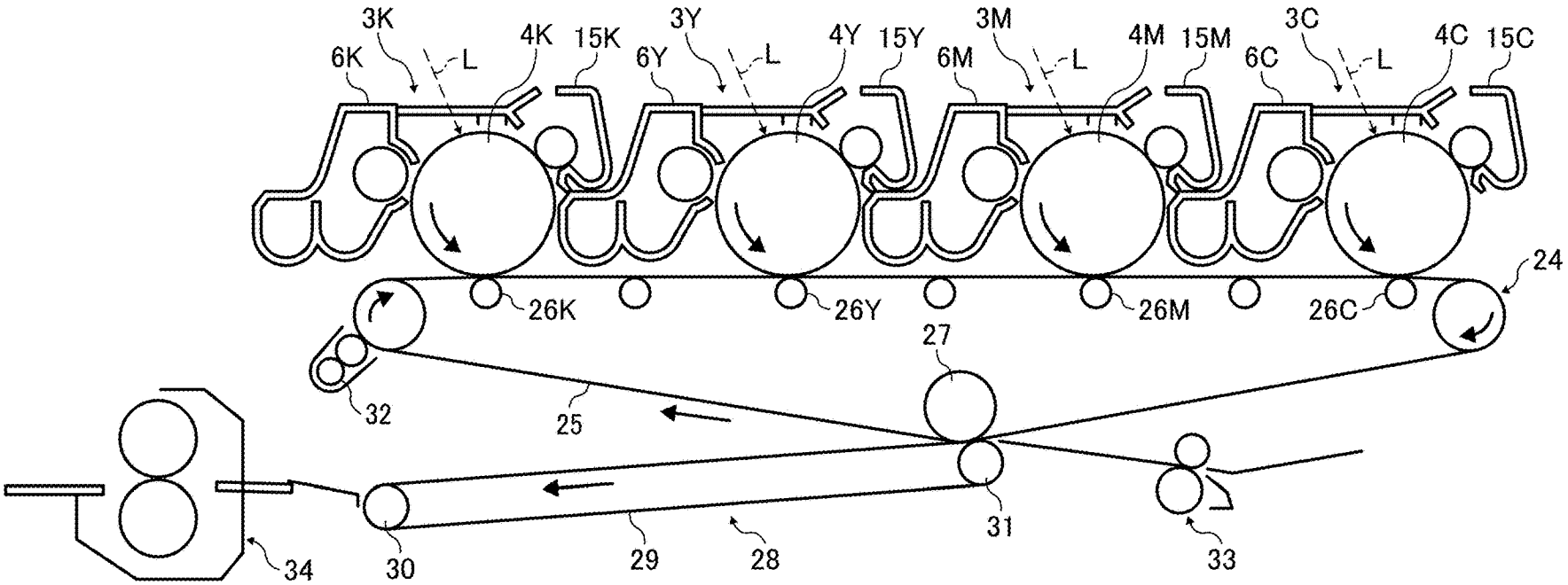
FIG. 2 is a diagram illustrating a partially enlarged configuration of an image forming device included in the copier of FIG. 1.

FIG. 2 is a diagram illustrating a partially enlarged configuration of the image forming device 1 included in the copier 500 of FIG. 1.

As illustrated in FIG. 2, the image forming device 1 includes an optical writing device 2, four process units 3K, 3Y, 3M, and 3C, and a transfer unit 24. The process units 3K, 3Y, 3M, and 3C form a black toner image, a yellow toner image, a magenta toner image, and a cyan toner image, respectively. The image forming device 1 further includes a sheet conveying unit 28, a registration roller pair 33, a fixing device 34, a switchback device 36, and the sheet conveyance passage 37. The optical writing device 2 includes a light source such as a laser diode and a light emitting diode (LED). The light source is disposed in the optical writing device 2. By driving the light source in the optical writing device 2, laser lights L are emitted toward four drum-shaped photoconductors 4K, 4Y, 4M, and 4C to irradiate respective surfaces of the drum-shaped photoconductors 4K, 4Y, 4M, and 4C. Due to this irradiation, electrostatic latent images of respective single colors are formed on the surfaces of the photoconductors 4K, 4Y, 4M, and 4C, which will be developed to visible toner images via a given development process. Suffixes K, Y, M, and C denote colors black, yellow, magenta, and cyan, respectively. To simplify the description, these suffixes may be omitted unless necessary in the following description.

The process units 3K, 3Y, 3M, and 3C also include respective image forming units disposed around each of the photoconductors 4K, 4Y, 4M, and 4C as a single unit supported by a common support member, respectively. The process units 3K, 3Y, 3M, and 3C are detachably attached to the image forming device 1 of the copier 500 serving as an image forming apparatus. The process unit 3 (i.e., the process units 3K, 3Y, 3M, and 3C) includes the photoconductor 4 (i.e., the photoconductors 4K, 4Y, 4M, and 4C) and a developing device 6 (i.e., developing devices 6K, 6Y, 6M, and 6C) that develops an electrostatic latent image formed on a surface of the photoconductor 4 into a visible toner image. The process unit 3 further include a drum cleaning device 15 (i.e., drum cleaning devices 15K, 15Y, 15M, and 15C). The drum cleaning device 15 removes transfer residual toner remaining on the surface of the drum cleaning device 15 after the photoconductor 4 has passed the primary transfer nip region for the photoconductor 4 and cleans the surface of the photoconductor 4. The copier 500 serving as an image forming apparatus is a tandem image forming apparatus in which the four process units 3K, 3Y, 3M, and 3C are aligned in a direction of movement of an intermediate transfer belt 25 as an endless loop.

Figure 3:
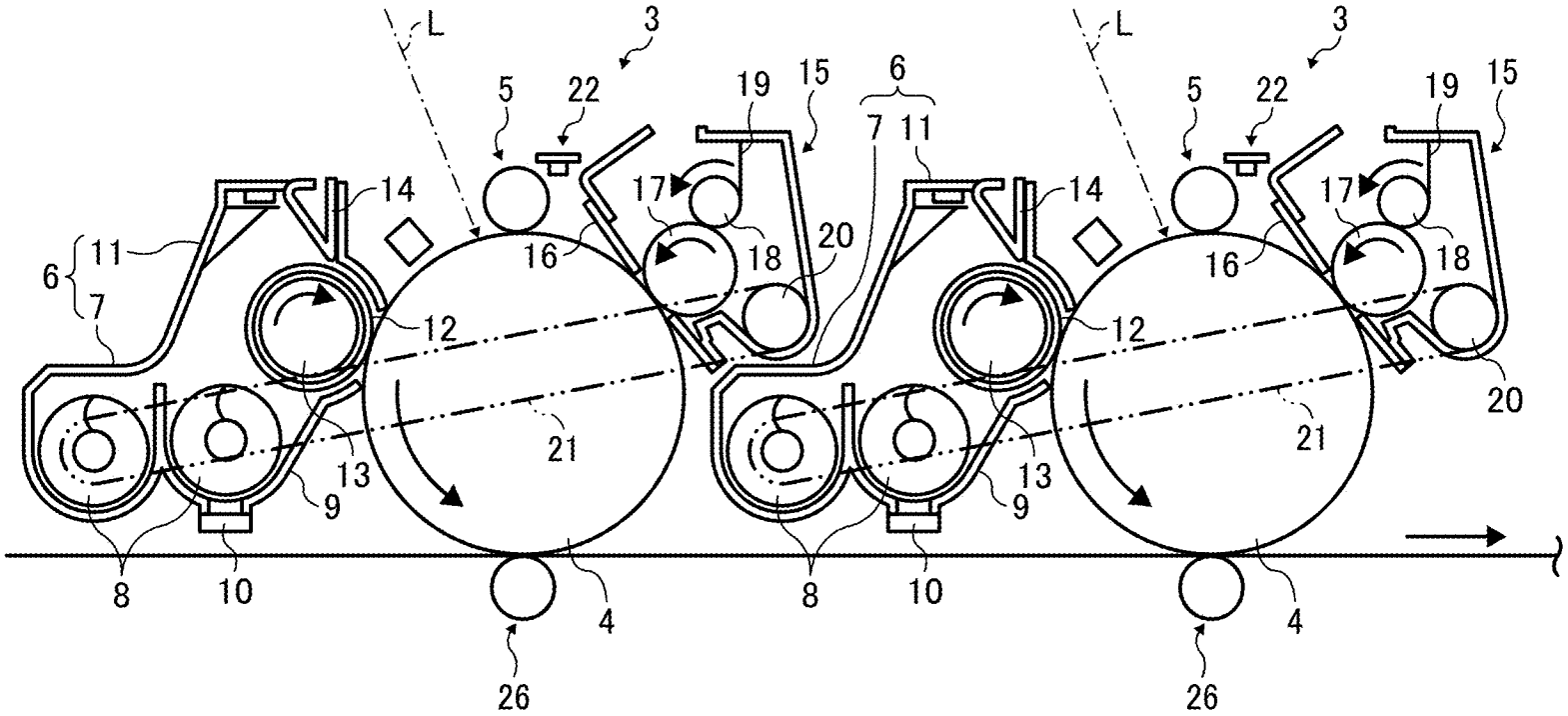
FIG. 3 is an enlarged view of a part of a tandem portion including four process units of the image forming device of FIG. 2.

FIG. 3 is an enlarged view of a part of a tandem portion including the four process units 3K, 3Y, 3M, and 3C.

Since the process units 3K, 3Y, 3M, and 3C have respective configurations substantially identical to each other except the toner colors, the process units 3K, 3Y, 3M, and 3C are also described without suffixes indicating the toner colors, which are K, Y, M, and C in FIG. 3. For example, the process units 3K, 3Y, 3M, and 3C are hereinafter referred to as a "process unit 3" in a single form occasionally. The process unit 3 (i.e., the process units 3K, 3Y, 3M, and 3C) includes the photoconductor 4 (i.e., the photoconductors 4K, 4Y, 4M, and 4C), and a charging device 5, the developing device 6 (i.e., the developing devices 6K. 6Y, 6M, and 6C), the drum cleaning device 15 (i.e., the drum cleaning devices 15K, 15Y, 15M, and 15C), and an electric discharging lamp 22 around the photoconductor 4.

The photoconductor 4 is manufactured by a hollow tube made of aluminum, for example, with a drum shape covered by an organic photoconductive layer having photosensitivity. Each of the photoconductors 3Y, 3M, 3C, and 3K may include an endless belt.

The developing device 6 develops an electrostatic latent image into a visible toner image by a two-component developer including magnetic carrier particles and non-magnetic toner. The two-component developer is now referred to as a "developer". The developing device 6 includes an agitating portion 7 and a development portion 11. The agitating portion 7 stirs the two-component developer accommodated therein and conveys the two-component developer to a development sleeve 12. The development portion 11 supplies the non-magnetic toner, which is included in the two-component developer and held by the development sleeve 12, to the photoconductor 4.

The agitating portion 7 is located at a position lower than the development portion 11 and includes two screw, a partition, a development case 9, and a toner concentration sensor 10. The two transfer screws 8 are disposed in parallel to each other. The partition is disposed between the two transfer screws 8. The development case 9 has an opening or a slot to face the photoconductor 4. The toner concentration sensor 10 is disposed on the bottom of the development case 9.

The development portion 11 includes the development sleeve 12, a magnetic roller 13, and a doctor blade 14. The development sleeve 12 faces the photoconductor 4 through the opening (or the slot) of the development case 9. The magnetic roller 13 is fixedly or non-rotatably disposed inside the development sleeve 12. The doctor blade 14 is disposed adjacent to the development sleeve 12 and the leading end of the doctor blade 14 is disposed close to the development sleeve 12. The development sleeve 12 has a non-magnetic, rotatable tubular body. The magnetic roller 13 has multiple magnetic poles arranged in the order in a rotation direction of the development sleeve 12, starting from an opposed position to the doctor blade 14. Each of these magnetic poles applies a magnetic force at a predetermined position in the rotation direction of the development sleeve 12, with respect to the two-component developer supplied on the development sleeve 12. With this action of the magnetic roller 13, the two-component developer that is conveyed from the agitating portion 7 is attracted and attached to the surface of the development sleeve 12 and a magnetic brush of toner is formed along the lines of the magnetic force on the surface of the development sleeve 12.

In accordance with rotation of the development sleeve 12, the magnetic brush is regulated to have an appropriate layer thickness when passing by the opposed position to the doctor blade 14. Then, the magnetic brush is moved to a development region facing the photoconductor 4. Due to a difference of potentials between a development bias that is applied to the development sleeve 12 and an electrostatic latent image formed on the surface of the photoconductor 4, the toner is transferred onto the electrostatic latent image, so that the electrostatic latent image is developed into a visible toner image. Further, after returning into the development portion 11 again along the rotation of the development sleeve 12 then leaving from the surface of the development sleeve 12 due to repulsion of the magnetic field formed between the magnetic poles of the magnetic roller 13, the two-component developer in a form of the magnetic brush is returned to the agitating portion 7. An appropriate amount of toner is supplied to the two-component developer in the agitating portion 7 based on a result or results detected by the toner concentration sensor 10. Alternative to the two-component developer, the developing device 6 according to the present embodiment may employ one-component developer that does not include magnetic carriers.

In the present embodiment, the drum cleaning device 15 employs a method of pressing a cleaning blade 16 made of a polyurethane rubber pressed against the photoconductor 4. However, in some embodiments, any other suitable cleaning method may be used.

The fur brush 17 according to the present embodiment is provided in order to increase cleanability. The fur brush 17 is a conductive member and the outer circumferential surface of the fur brush 17 slidably contacts the photoconductor 4. The fur brush 17 according to the present embodiment is rotatable in a direction indicated by arrow in FIG. 4. The fur brush 17 also functions as an applier that scrapes a solid lubricant to obtain fine powder of lubricant and applies the scraped fine powder to the surface of the photoconductor 4. The electric field roller 18 is a metallic member that applies a bias to the fur brush 17. The electric field roller 18 is disposed rotatably in a direction indicated by arrow in FIG. 3. The scraper 19 has a leading end that is pressed against the electric field roller 18. The toner removed from the photoconductor 4 and attached to the fur brush 17 is transferred onto the electric field roller 18 that contacts the fur brush 17 in a counter direction to be applied with a bias while the electric field roller 18 is rotating. After being scraped and removed from the electric field roller 18 by the scraper 19, the toner falls onto the collection screw 20. The collection screw 20 conveys the toner collected from the surface of the photoconductor 4 toward an end portion of the drum cleaning device 15 in a direction perpendicular to the drawing sheet, and transfers the collected toner to an external toner recycling transfer device 21. The external toner recycling transfer device 21 sends the collected toner to the developing device 6 for recycling.

The electric discharging lamp 22 removes residual electric charge remaining on the surface of the photoconductor 4 by photo irradiation. After such residual electric charge is removed, the electrically discharged surface of the photoconductor 4 is uniformly charged by the charging device 5 again and then optically irradiated by the optical writing unit 2. In the copier 500 serving as an image forming apparatus according to the present embodiment, the charging device 5 is a charging roller that is applied with charging bias and rotates while contacting the photoconductor 4. However, in some embodiments, the charging device 5 may be a scorotron charger that performs a charging process on the photoconductor 4 in non-contact with the photoconductor 4.

According to the above-described operations with the configuration illustrated in FIG. 2, black (K), yellow (Y), magenta (M), and cyan (C) toner images are formed on the photoconductors 4K, 4Y, 4M, and 4C of the process units 3K, 3Y, 3M, and 3C, respectively.

The transfer unit 24 is disposed below the process units 3K, 3Y, 3M, and 3C. The transfer unit 24 endlessly moves the intermediate transfer belt 25 in the clockwise direction in FIG. 2 while the intermediate transfer belt 25 is stretched by and would around multiple rollers and is in contact with the photoconductors 4K, 4Y, 4M, and 4C. By so doing, respective primary transfer nip regions for forming black, yellow, magenta, and cyan images are formed between the photoconductors 4K, 4Y, 4M, and 4C and the intermediate transfer belt 25 in contact with each other. In proximity to each of the primary transfer nip regions for black, yellow, magenta, and cyan images, the primary transfer rollers 26 (i.e., the primary transfer rollers 26K, 26Y, 26M, and 26C) are disposed in contact with the inner loop of the intermediate transfer belt 25 to press the intermediate transfer belt 25 against the photoconductors 4 (i.e., the photoconductors 4K, 4Y, 4M, and 4C), respectively. A primary transfer bias is applied by respective transfer bias power supplies to the primary transfer rollers 26K, 26Y, 26M, and 26C. Consequently, respective primary transfer electric fields are generated in the primary transfer nip regions to electrostatically transfer respective toner images formed on the photoconductors 4K, 4Y, 4M, and 4C onto the intermediate transfer belt 25. As the intermediate transfer belt 25 passes through the primary transfer nip regions along the endless rotation in the clockwise direction in FIG. 2, the black, yellow, magenta, and cyan toner images are sequentially transferred at the primary transfer nip regions and overlaid onto an outer circumferential surface of the intermediate transfer belt 25. Due to the primary transfer of the toner images, a four-color composite toner image (referred to as a four-color toner image) is formed on the surface of the intermediate transfer belt 25.

The sheet conveying unit 28 is disposed below the transfer unit 24 in FIG. 2. The sheet conveying unit 28 includes a sheet transfer belt 29, a drive roller 30, and a secondary transfer roller 31. The sheet transfer belt 29 is an endless belt that is wound around the drive roller 30 and the secondary transfer roller 31 and rotates in a direction indicated by arrow in FIG. 2. As illustrated in FIG. 2, the intermediate transfer belt 25 and the sheet transfer belt 29 are sandwiched between the secondary transfer roller 31 and a lower tension roller 27 of the transfer unit 24. According to this configuration, a secondary transfer nip region is formed between the surface of the intermediate transfer belt 25 and the surface of the sheet transfer belt 29 contacting with each other. A secondary transfer bias is applied by a transfer bias power source to the secondary transfer roller 31. On the other hand, the lower tension roller 27 of the transfer unit 24 is electrically grounded. By so doing, a secondary transfer electric field is formed in the secondary transfer nip region.

The registration roller pair 33 is disposed on the right side of the secondary transfer nip region in FIG. 2. The registration roller pair 33 nips the transfer sheet P between the rollers and conveys the transfer sheet P to the secondary transfer nip region in synchronization with arrival of the four-color toner image formed on the intermediate transfer belt 25 so as to further convey the transfer sheet P toward the secondary transfer nip region. In the secondary transfer nip region, the four-color toner image formed on the intermediate transfer belt 25 is transferred onto the transfer sheet P due to the secondary transfer electric field and a nip pressure. At this time, the four-color toner image is combined with white color of the transfer sheet P to make a full-color toner image. After passing through the secondary transfer nip region, the transfer sheet P having the full-color toner image on the surface is separated from the intermediate transfer belt 25. Then, while being held on the surface of the sheet transfer belt 29, the transfer sheet P is conveyed to the fixing device 34 along with endless rotation of the sheet transfer belt 29 in the direction indicated by arrow in FIG. 2.

Residual toner that has not been transferred onto the transfer sheet P in the secondary transfer nip region remains on the surface of the intermediate transfer belt 25 after the intermediate transfer belt 25 has passed through the secondary transfer nip region. The residual toner is scraped and removed from the surface of the intermediate transfer belt 25 by a belt cleaning device 32 that is disposed in contact with the surface of the intermediate transfer belt 25.

The transfer sheet P is conveyed to the fixing device 34. The fixing device 34 fixes the full-color toner image to the transfer sheet P by application of heat and pressure. Then, the transfer sheet P is conveyed from the fixing device 34 to the sheet ejection roller pair 35 to be ejected to the outside of the copier 500.

As illustrated in FIG. 1, the switchback device 36 is disposed below the sheet conveying unit 28 and the fixing device 34. As a result of the above-described operation, after the image fixing operation is performed on one side or the surface of the transfer sheet P, a separator switches the direction of conveyance of the transfer sheet P. Specifically, the direction of conveyance of the transfer sheet P is switched to a passage to a transfer reversal device by the separator. When the transfer sheet P is conveyed to the transfer reversal device, the transfer sheet P is reversed to enter the secondary transfer nip region of the copier 500 again. In the copier 500, a toner image is secondarily transferred onto the other side or a back face of the transfer sheet P so that the secondary transfer process and the fixing process are executed. Then, the transfer sheet P is ejected onto the ejection tray.

The scanner 150 is fixedly mounted on the image forming device 1 and includes a first fixed reading unit 151 serving as a first face reader, and a movable scanning unit 152 serving as a first face reader.

The movable scanning unit 152 serving as a first face reader is disposed immediately below a second exposure glass 155 (see FIG. 4) that is fixedly mounted on an upper wall of a casing of the scanner 150 so as to contact an original document MS. The movable scanning unit 152 includes a light source and optical process units such as multiple reflection mirrors, so that these optical units can move in a horizontal direction (in other words, left and right directions) in FIG. 1. In the course of moving the optical components from left to right in FIG. 1, the light source emits the light. After a surface of the original document MS placed on the second exposure glass 155 reflects light, the reflected light is further reflected on multiple reflection mirrors until an image reading sensor 153 that is fixed to the scanner 150 receives the reflected light.

The first fixed reading unit 151 serving as a first face reader is disposed immediately below a first exposure glass 154 (see FIG. 4) that is fixedly mounted on the upper wall of the casing of the scanner 150, so that the first exposure glass 154 contacts the original document MS. When the original document MS that is conveyed by the ADF 51 that will be described below passes over the first exposure glass 154, the light source emits light. After a document face of the original document MS sequentially reflects the light emitted from the light source, the reflected light is further reflected on multiple reflection mirrors until the image reading sensor 153 receives the reflected light. By so doing, the first face of the original document MS is scanned without moving the optical components such as the light source and the multiple reflection mirrors.

Further, the scanner 150 also includes a contact image sensor 95 (see FIG. 5) that reads the second side of the original document MS. The contact image sensor 95 is described below.

The ADF 51 that is disposed on the scanner 150 includes a body cover 52, a document loading tray 53, a document conveyance unit, and a document stacker 55. The body cover 52 holds and supports the document loading tray 53, the document conveyance unit, and the document stacker 55.

Figure 4:
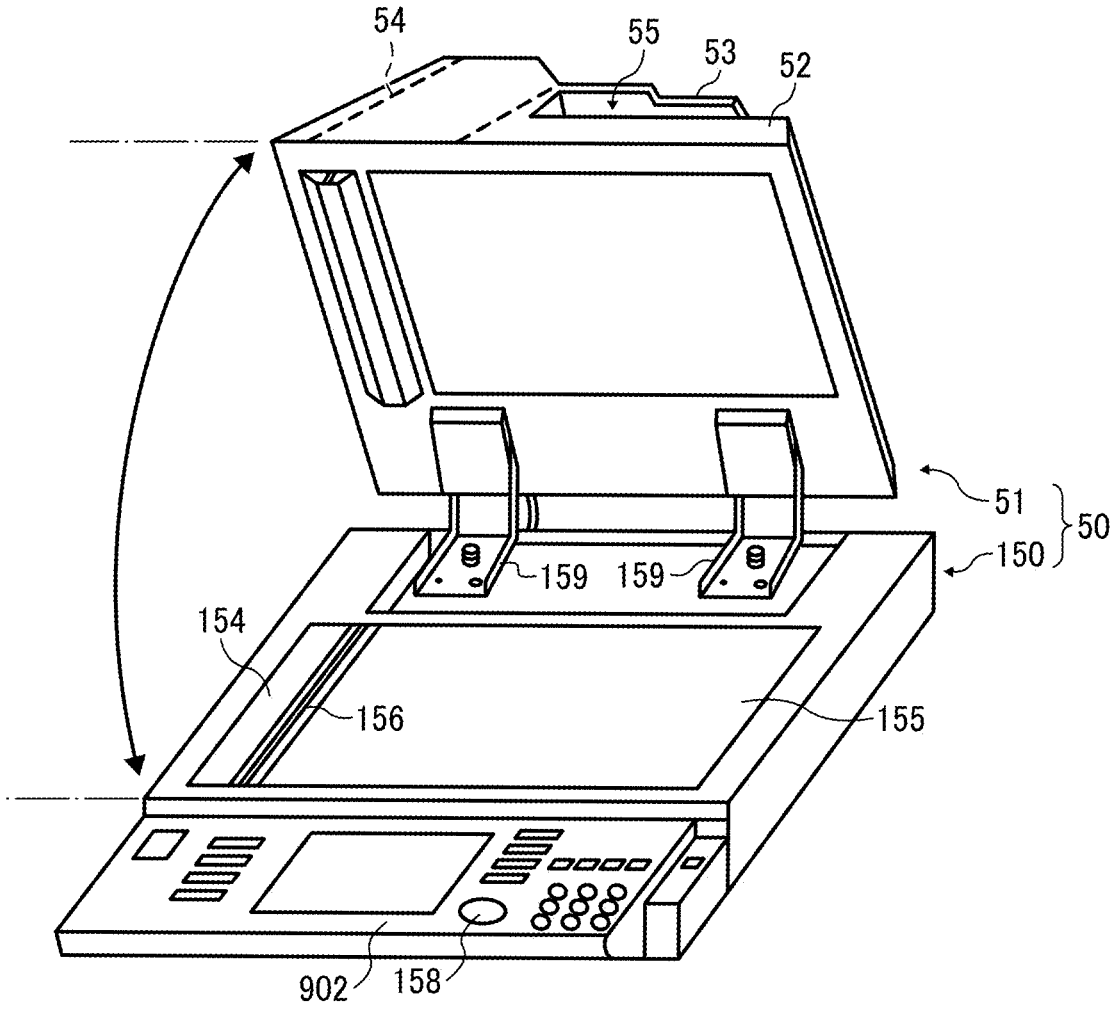
FIG. 4 is a perspective view of a scanner and an automatic document feeder of the copier of FIG. 1.

The document loading tray 53 loads the original document MS to be read. The document conveyance unit conveys the original document MS. The document stacker 55 receives and stacks the original document MS after the original document MS is read. As illustrated in FIG. 4, hinges 159 each being fixed to the scanner 150 rotatably support the scanner in the upward and downward directions. With the rotation of the ADF 51 in the upward and downward directions, the ADF 51 works as an opening door, so that the first exposure glass 154 and the second exposure glass 155 on the upper face of the scanner 150 are exposed while the ADF 51 is open. In a case of the one-sided bound documents such as a book of a document bundle bounded on one-side, the original documents MS cannot be separated one by one. For this reason, the original documents MS cannot be conveyed by the ADF 51. When reading the one-sided bound documents, the ADF 51 is opened as illustrated in FIG. 4. Then, the one-sided bound documents opened are placed on the second exposure glass 155 with a page to be read facing down. Then, the scanner 150 causes the movable scanning unit 152 to read the image on the page of the one-sided bound documents placed facedown.

On the other hand, when the original documents MS are in a form of a document bundle of simply accumulated individual original documents MS, the original documents MS are sequentially read by the first fixed reading unit 151 in the scanner 150 or the contact image sensor 95 in the ADF 51 while the ADF 51 automatically conveys the original documents MS one by one. In this case, a copy start button 158 (see FIG. 4) of an apparatus control panel 902 (see FIG. 6) is pressed after the bundle of original documents MS is set on the document loading tray 53. Then, the ADF 51 starts conveyance of the original documents MS that is a bundle of original documents stacked on the document loading tray 53 to convey each original document MS sequentially from top of the bundle of original documents MS to the document stacker 55. In the course of this conveyance of the original documents MS, immediately after the original document MS is reversed, the original document MS is caused to pass immediately above the first fixed reading unit 151 of the scanner 150. At this time, the image on the first face of the original document MS is read by the first fixed reading unit 151 of the scanner 150.

Figure 5:
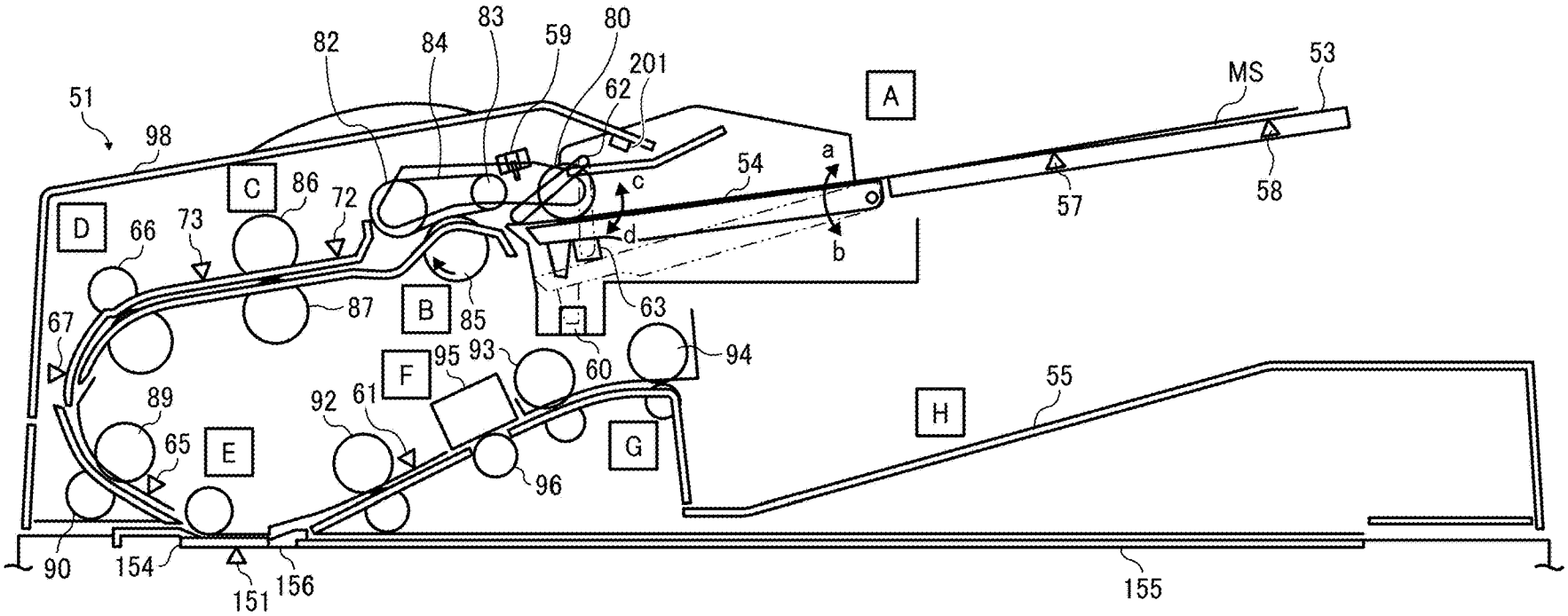
FIG. 5 is an enlarged view of the automatic document feeder and the upper part of the scanner.

FIG. 5 is a diagram illustrating an enlarged part of the configuration of the ADF 51 and the upper part of the scanner 150.

Figure 6:
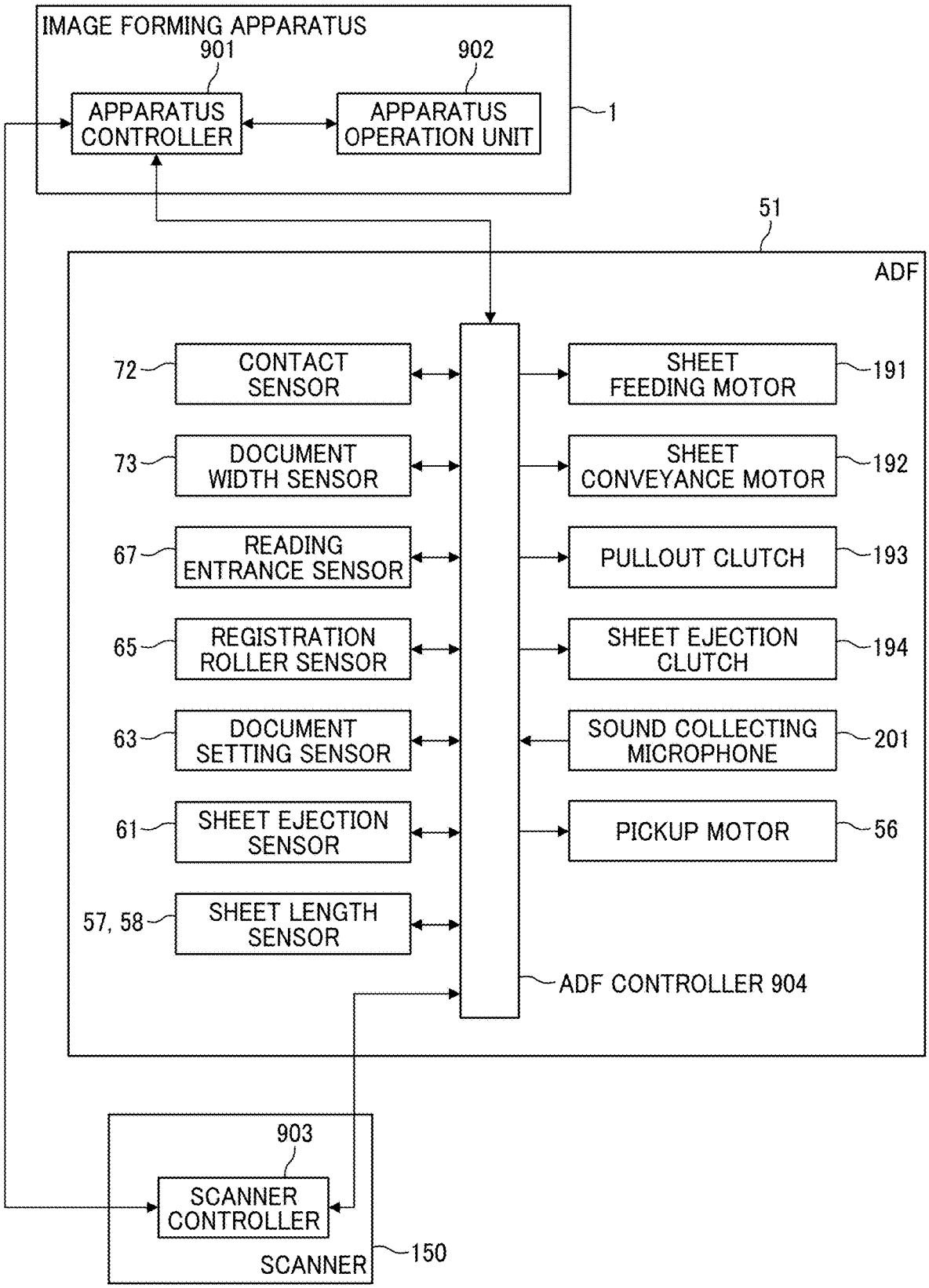
FIG. 6 is a block diagram illustrating a part of an electric circuit of the automatic document feeder and the scanner.

FIG. 6 is a block diagram illustrating a part of an electric circuit of the ADF 51 and the scanner 150.

As illustrated in FIG. 5, the ADF 51 according to the present embodiment includes a document setting part A, a document separating and feeding part B, a registration part C, a document turning part D, a first reading and conveying part E, a second reading and conveying part F, a document ejecting part G, and a document stacking part H.

As illustrated in FIG. 6, the ADF 51 includes an ADF controller 904 provided with an application specific integrated circuit (ASIC) to control various components and sensors in the ADF 51. The ADF controller 904 is connected to a registration sensor 65, a document set sensor 63, a document ejection sensor 61, a document contact sensor 72, a document width sensor 73, a scan entrance sensor 67, a first document length sensor 57, and a second document length sensor 58, as illustrated in FIG. 6. The ADF controller 904 is further connected to, for example, a sheet feeding motor 191, a sheet conveyance motor 192, a pullout clutch 193, a sheet ejection clutch 194, and a pickup motor 56. The ADF controller 904 is further connected to a sound collection microphone 201 serving as a sound collector.

The sound collection microphone 201 collects sound occurring when the original document MS is conveyed. As illustrated in FIG. 5, in the present embodiment, the sound collection microphone 201 is attached on the inner circumferential face of a sheet feeder cover 98 that is openable and closable, and is disposed above the original document MS placed on the document loading tray 53 disposed upstream from the pickup roller 80 serving as a sheet feed roller in a document feeding direction. As illustrated in FIG. 5, in the present embodiment, the sound collection microphone 201 is attached on the inner circumferential face of a sheet feeder cover 98 that is openable and closable, and is disposed above the original document MS placed on the document loading tray 53 disposed upstream from the pickup roller 80 serving as a sheet feed roller in a document feeding direction.

The positions of the sound collection microphones 201 are not limited to the above-described configuration. For example, a sound collection microphone may be disposed between the pickup roller 80 and a sheet feed belt 84 where sound is well collected without a member that blocks the operating sounds generated when the sheet feeding or separating operation. As the sound collection microphones 201 are disposed on the inner circumferential face of the sheet feeder cover 98, noise from outside the ADF 51 can be shut down by the sheet feeder cover 98 and the sound collection microphones 201 are made difficult to pick up noise from outside of the ADF 51. Alternatively, when disposing the sound collection microphones 201 on the inner circumferential face of the sheet feeder cover 98, a rubber vibration member may be disposed between the sound collection microphone 201 and the inner circumferential face of the sheet feeder cover 98, which can be made difficult to pick up noise due to vibration from the sheet feeder cover 98.

Further, the sound that occurs along with a document feeding operation (i.e., driving of the pickup roller 80) including the sound of the driving mechanism of the pickup roller 80 serving as a sheet feed roller is collected as an operating sound generated when the original document is fed. Among the sound that occurs along with the document feeding operation (i.e., the driving of the pickup roller 80), the sound that occurs when the sheet is conveyed by the pickup roller 80, for example, only the conveyance sound of the sheet that occurs due to friction with a sheet to be fed or deformation of the sheet may be collected as an operating sound by removing the sound of the driving mechanism using a band pulse filter.

As illustrated in FIG. 6, the scanner 150 includes a scanner controller 903 including a central processing unit (CPU) and a random access memory (RAM). With the scanner controller 903, various components and sensors in the scanner 150 can be controlled. Further, the scanner controller 903 is connected to the ADF controller 904 of the ADF 51 via the interface (I/F). The scanner controller 903 may indirectly control the various components and sensors in the ADF 51 via the ADF controller 904.

In FIG. 5, the document setting part A has the document loading tray 53 on which a bundle of original documents MS is set. The document separating and feeding part B separates the original documents MS one by one from the bundle of original documents MS set on the document loading tray 53 in the document setting part A to feed the separated original document MS. Further, in the registration part C, the original document MS fed from the document separating and conveying part B temporarily contacts the pullout driven roller 86 and the pullout drive roller 87 to be aligned and fed again.

The document turning part D has a conveyance passage curved in a C-shape, and turns the original document MS to be conveyed in the curved conveyance passage so as to reverse the original document MS upside down while turning the original document MS. Then, in the first reading and conveying part E, the first fixed reading unit 151 disposed in the scanner 150 below the first exposure glass 154 as illustrated in FIG. 1 reads the first face of the original document MS while the original document MS is being conveyed on the first exposure glass 154. Further, in the second reading and conveying part F, the contact image sensor 95 reads the second face of the original document MS while the original document MS is conveyed under the contact image sensor 95. After the images on both sides of the original document MS, the original document MS is conveyed in the document ejecting part G to be ejected toward the document stacking part H. In the document stacking part H, the document stacker 55 stacks the original documents MS.

The original document MS is set in the document setting part A with the leading end of the original document MS placed on the movable document table 54 serving as a sheet tray pivotable in the directions indicated by arrows "a" and "b" in FIG. 5 depending on the thicknesses of a bundle of the original documents MS and the trailing end of the original document MS placed on the document loading tray 53. At this time, the side guides of the document loading tray 53 contact both lateral side ends of the original document MS in the width direction (i.e., the direction orthogonal to the drawing sheet) to adjust the position of the original document MS in the width direction. The original documents MS thus set push up a lever 62 that is pivotably disposed above the movable document table 54.

Along with this movement of the original documents MS, the document set sensor 63 detects the setting of the original documents MS, and transmits the detection signal to the ADF controller 904 (see FIG. 6). The detection signal is then transmitted from the ADF controller 904 to the scanner controller 903 via the I/F.

The first document length sensor 57 and the second document length sensor 58 are held on the document loading tray 53. Each of the first document length sensor 57 and the second document length sensor 58 includes a reflective photosensor or an actuator-type sensor for detecting the length of the original document MS in the sheet conveyance direction. The length of the original document MS in the sheet conveyance direction is detected with the first document length sensor 57 and the second document length sensor 58.

The pickup roller 80 is supported by the cam mechanism to be movable in the vertical direction (i.e., the directions indicated by arrows "c" and "d" in FIG. 5) and is disposed above the bundle of original documents MS stacked on the movable document table 54. The cam mechanism is driven by the pickup motor 56 to move the pickup roller 80 in the vertical direction. As the pickup roller 80 moves upward, the movable document table 54 rotates in the direction indicated by arrow "a" in FIG. 5, so that the pickup roller 80 is brought to contact the uppermost original document MS placed on top of the bundle of original documents MS. As the movable document table 54 further moves upward, a table lifting sensor 59 detects that the movable document table 54 moves up to the maximum height. In response to this detection, the pickup motor 56 stops driving to stop the movable document table 54 from moving up. As described above, as the pickup roller 80 moves upward, the movable document table 54 rotates in the direction indicated by arrow "a" in FIG. 5. When the movable document table 54 is lowered to a home position, a feeler provided in a lower part of the movable document table 54 is detected by a home position sensor 60.

The apparatus control panel 902 (see FIG. 6) including, for example, a numeric keypad and a display provided in the housing of the copier 500 is operated by an operator to perform a key operation for setting a reading mode indicating a double-sided reading mode or a single-sided reading mode and a pressing operation of a copy start key. In other words, the apparatus control panel 902 functions as a mode information acquisition unit that acquires information indicating whether the reading mode is the double-sided reading mode or the single-sided reading mode. The reading mode includes a thin paper mode for reading thin paper and a mixed mode in which original documents MS of different sizes are mixed and conveyed. The operator can set the thin paper mode or the mixed mode by the key operation on the apparatus control panel 902 by the operator. In the thin paper mode or the mixed mode, the original document MS is conveyed at a conveyance speed of the original document MS totally slower than the normal reading mode.

As the copy start button 158 is pressed down, a document feeding signal is sent from an apparatus controller 901 to the ADF controller 904 of the ADF 51 via the I/F. In response to the sending of the document feeding signal, the pickup roller 80 is rotated along with the forward rotation of the sheet feeding motor 191, so that the original documents MS on the movable document table 54 are fed from the movable document table 54.

The setting of the double-sided reading mode or the single-sided reading mode collectively covers the whole original documents MS stacked on the movable document table 54. To be more specific, when the double-sided reading mode or the single-sided reading mode is set, both sides or a single-side of the whole original documents MS stacked on the movable document table 54 can be read. In addition, individual reading mode setting can be performed on separate ones of the original documents MS. For example, the double-sided reading mode can be applied to the first and 10th original documents MS while the single-sided reading mode can be applied to the other original documents MS.

The original document MS fed by the pickup roller 80 enters the document separating and feeding part B to be fed to the contact position with the sheet feed belt 84. The sheet feed belt 84 is wound and stretched by a drive roller 82 and a driven roller 83 to be endlessly moved in the clockwise direction in FIG. 5 by rotation of the drive roller 82 along with the forward rotation of the sheet feeding motor 191. A separation roller 85 is in contact with the lower stretched face of the sheet feed belt 84 to be rotated in the clockwise direction in FIG. 5 along with the forward rotation of the sheet feeding motor 191. At the contact portion, the sheet feed belt 84 is rotated so that the surface of the sheet feed belt 84 moves in the sheet conveyance direction.

By contrast, the separation roller 85 is in contact with the sheet feed belt 84 with a given pressure. When the separation roller 85 directly contacts the sheet feed belt 84 or a single original document MS is nipped in the contact portion, the separation roller 85 is rotated with rotation of the sheet feed belt 84 or movement of the original document MS. However, when multiple original documents MS are nipped in the contact portion, the force of the separation roller 85 to be rotated with rotation of the sheet feed belt 84 or movement of the original document MS is lower than the torque of a torque limiter. For this reason, the separation roller 85 is rotated in the clockwise direction that is opposite to a direction in which the separation roller 85 is rotated. As a result, the separation roller 85 applies the force of movement in the direction opposite to the sheet conveyance direction, to the original documents MS under the uppermost original document MS, so that the uppermost original document MS is separated from the multiple original documents MS under the uppermost original document MS.

The original document MS is separated from the other original documents MS through the operation of the sheet conveyance members including the sheet feed belt 84 and the separation roller 85, and enters the registration part C. Then, the leading end of the original document MS is detected when the original document MS passes directly under the document contact sensor 72. At this time, the pickup roller 80 receiving the driving force of the sheet feeding motor 191 is still rotating. However, as the pickup roller 80 is separated from the original document MS due to descendance of the movable document table 54, the original document MS is conveyed only by an endless moving force of the sheet feed belt 84. Then, the endless movement of the sheet feed belt 84 is continued for a given time from the timing at which the leading end of the original document MS is detected by the document contact sensor 72. Then, the leading end of the original document MS contacts the contact portion of the pullout driven roller 86 serving as a conveyor and the pullout drive roller 87 serving as a conveyor that rotates while contacting the pullout driven roller 86. While the leading end of the original document MS contacts the contact portion of the pullout driven roller 86 and the pullout drive roller 87, the trailing end of the original document MS is conveyed in the sheet conveyance direction. By so doing, the leading end of the original document MS is positioned at the contact portion while the original document MS is bent by a given amount. Accordingly, skew (inclination) of an original document MS is corrected, and the original document MS is positioned correctly in the sheet conveyance direction.

The pullout drive roller 87 has a function of correcting skew of the original document MS, and further has a function of conveying the original document MS after skew correction to an intermediate roller pair 66 serving as a conveyor disposed downstream from the pullout drive roller 87 in the sheet conveyance direction. When the drive roller 82, the pullout drive roller 87, and the drive roller of the intermediate roller pair 66 wind and stretch the pickup roller 80 and the sheet feed belt 84 and are coupled to the sheet feeding motor 191 via respective one-way clutches. The one-way clutches coupled to the pullout drive roller 87 and the drive roller of the intermediate roller pair 66 transmit the driving force when the sheet feeding motor 191 rotates in the reverse direction. The one-way clutch coupled to the drive roller 82 transmits the driving force when the sheet feeding motor 191 rotates in the forward direction. For this reason, when the sheet feeding motor 191 rotates in the reverse direction, the pullout drive roller 87 and the drive roller of the intermediate roller pair 66 start rotating and the endless movement of the sheet feed belt 84 stops. At this time, the pickup roller 80 stops rotating.

The original document MS that is fed by the pullout drive roller 87 passes directly under the document width sensor 73. The document width sensor 73 includes multiple document detectors each including a reflective photosensor. The multiple document detectors are aligned in a row in the width direction of the original document MS (i.e., the direction orthogonal to the drawing sheet of FIG. 5). The size of the original document MS in the width direction is detected based on which one of the multiple document detectors detects the original document MS. The length of the original document MS in the sheet conveyance direction is detected based on the time from when the leading end of the original document MS is detected by the document contact sensor 72 to when the trailing end of the original document MS is not detected by the document contact sensor 72.

The leading end of the original document MS whose size in the width direction is detected by the document width sensor 73 enters the document turning part D and is nipped by the contact portion between the rollers of the intermediate roller pair 66. The conveyance speed of the original document MS conveyed by the intermediate roller pair 66 is set faster than the conveyance speed of the original document MS in the first reading and conveying part E that will be described below. This configuration achieves a reduction in time for entering the original document MS to the first reading and conveying part E.

The leading end of the original document MS conveyed in the document turning part D passes through a position where the leading end of the original document MS faces the scan entrance sensor 67. As a result, when the leading end of the original document MS is detected by the scan entrance sensor 67, the document conveyance speed of the original document MS by the intermediate roller pair 66 is reduced until the leading end of the original document MS is conveyed to the position of the scan entrance roller pair (including rollers 89 and 90) serving as a conveyor downstream from the scan entrance sensor 67 in the sheet conveyance direction. As the sheet conveyance motor 192 starts to drive and rotate, one roller of the scan entrance roller pair (including the rollers 89 and 90), one roller of a first scan exit roller pair 92, and one roller of a second scan exit roller pair 93 respectively start rotation.

In the document turning part D, while the original document MS is conveyed in the curved conveyance passage between the intermediate roller pair 66 and the scan entrance roller pair (including the rollers 89 and 90), the upper and lower faces of the original document MS are reversed, and the conveyance direction of the original document MS is turned back. Then, the leading end of the original document MS that has passed through the nip region between the rollers (89 and 90) of the scan entrance roller pair passes directly under the registration sensor 65. When the registration sensor 65 detects the leading end of the original document MS, the conveyance speed of the original document MS is gradually decreased through the given conveyance distance. Then, before the first reading and conveying part E, the conveyance of the original document MS is temporarily stopped. Further, a temporary stop signal is sent to the scanner controller 903 via the I/F.

After receiving the temporary stop signal, the scanner controller 903 sends a scanning start signal, the ADF controller 904 controls the sheet conveyance motor 192 resumes rotating to increase the conveyance speed of the original document MS up to the given conveyance speed until the leading end of the original document MS reaches the first reading and conveying part E. Then, at the timing at which the leading end of the original document MS reaches the reading position of the first fixed reading unit 151, the ADF controller 904 sends a gate signal indicating an effective image area of the first face of the original document MS in the sub-scanning direction, to the scanner controller 903. The ADF controller 904 continues sending the gate signal to the scanner controller 903 until the trailing end of the original document MS passes through the reading position of the first fixed reading unit 151, so that the first face of the original document MS is scanned by the first fixed reading unit 151. The timing at which the leading end of the original document MS reaches the reading position of the first fixed reading unit 151 is calculated based on the pulse count of the sheet conveyance motor 192. A left ruler 156 is disposed at a light corner of the second exposure glass 155. When scanning an original document MS, the original document MS is placed on the second exposure glass 155 by contacting at the scale of the left ruler 156 before being scanned.

The original document MS that has passed through the first reading and conveying part E passes through the first scan exit roller pair 92, which will be described below. Then, the leading end of the original document MS is detected by the document ejection sensor 61. When the single-sided reading mode is set, the second face of the original document MS is not required to be read by the contact image sensor 95, which will be described below. As the leading end of the original document MS is detected by the document ejection sensor 61, the driving force of the sheet conveyance motor 192 is connected to a document ejection roller pair 94 by the sheet ejection clutch 194 to rotate the lower ejection roller in FIG. 5 of the document ejection roller pair 94 in the clockwise direction in FIG. 5. The timing at which the trailing end of the original document MS passes through the nip region of the document ejection roller pair 94 is calculated based on the pulse count of the sheet conveyance motor 192 after the detection of the leading end of the original document MS by the document ejection sensor 61. Then, based on this calculation result, the driving force of the sheet conveyance motor 192 is cut by the sheet ejection clutch 194 to stop the document ejection roller pair 94.

On the other hand, when the double-sided reading mode is set, the document ejection sensor 61 initially detects the leading end of the original document MS. Then, the timing at which the original document MS reaches the contact image sensor 95 is calculated based on the pulse count of the sheet conveyance motor 192. Then, at the timing at which the leading end of the original document MS reaches the contact image sensor 95, the ADF controller 904 sends a gate signal indicating the effective image area of the second face of the original document MS in the sub-scanning direction, to the scanner controller 903. The ADF controller 904 continues sending the gate signal to the scanner controller 903 until the trailing end of the original document MS passes through the reading position of the contact image sensor 95, so that the second face of the original document MS is scanned by the contact image sensor 95.

Then, the reading face of the contact image sensor 95 (CIS) serving as a second reader is coated for the purpose of preventing a reading vertical streak due to the paste-like foreign substance adhering to the original document MS adhering to the reading face of the contact image sensor 95. A reading roller 96 as a document supporter that supports the original document MS from a non-reading face side (i.e., the first face side) is disposed at a position facing the contact image sensor 95. The reading roller 96 serves as a floating retainer that prevents the original document MS from floating up at the reading position of the contact image sensor 95 and as a reference white portion for acquiring shading data in the contact image sensor 95. In the copier 500, the reading roller 96 is used as a document supporter that supports the original document MS at a position facing the contact image sensor 95. However, a member such as a guide plate may be used as a document supporter instead of the reading roller 96 having a roller shape.

When the original document MS is fed, the pickup roller 80 conveys the original document MS against a frictional force between the original document MS to be fed and an original document MS immediately below the original document MS or the movable document table 54. Under such a condition, the original document MS may easily slip on the pickup roller 80. Further, the pickup roller 80 and the movable document table 54 move in the vertical direction to contact or separate from the original document MS. This change of the contact state may also cause the original document MS to easily slip on the pickup roller 80. Due to such a slip on the pickup roller 80, it is likely that the original document MS is not conveyed to a specified position within a given time, resulting in a paper jam.

If a paper jam occurs as an abnormal conveyance after the original document MS is conveyed to the ADF 51 to some extent, the jammed original document MS is difficult to be removed, and may be wrinkled or tom when the jammed original document MS is removed from the ADF 51. Under such condition, the original document MS is likely to be damaged.

In addition, a bundle of original documents MS bound by metal pieces such as staples and clips may be set on the document loading tray 53 due to user's carelessness. When such a bundle of original documents MS thus bound is fed, it is likely that a paper jam occurs at the sheet separation portion that is the contact portion of the separation roller 85 and the sheet feed belt 84. Moreover, as the leading end of the bundle of original documents MS bound by metal pieces such as staples and clips enter the sheet separation portion, the uppermost original document MS placed on top of the bundle of original documents MS is continuously conveyed by the sheet feed belt 84. However, the second and subsequent original documents receive a conveyance force by the separation roller 85 to return the second and subsequent original documents MS to the document loading tray 53. As a result, a large stress is applied to the portions at which the bundle of original documents MS are bound by the metal piece. Due to such a large stress, the original documents MS are tom, bent, and wrinkled, and may be damaged.

For this reason, in the present embodiment, whether a paper jam occurs is predicted and determined from the operating sounds collected by the sound collection microphone 201 when the original document MS is conveyed. If a paper jam is likely to occur, the conveyance of the original documents MS is stopped to forestall a paper jam and damage to the original documents MS. In addition, at the time of stopping the conveyance of the original documents MS, the possibility of occurrence of a paper jam may be displayed on the display panel of the apparatus control panel 902 or a warning sound may be emitted from a speaker.

In the present embodiment, the feature of an operating sound generated when the original documents are conveyed is collected by the sound collection microphone 201. The feature that quantitatively describes the feature of the operating sound is extracted and abnormal conveyance of the original documents MS is determined a Mahalanobis-Taguchi (MT) method based on the extracted feature. The MT method is one of Mahalanobis-Taguchi (MT) system known for prediction, diagnosis and analysis based on multidimensional information data in the field of, for example, quality engineering. The MT method is one of methods that can determine whether the data is normal or abnormal by using the Mahalanobis distance, and is a method that can determine whether the condition is normal or abnormal in a simple manner and with relatively high accuracy. A detailed description of the MT method is omitted as the MT method is a publicly known method described in, for example, Japanese Patent Application Laid-Open No. 2003-141306.

As index data used for determining an abnormal conveyance, the following data is stored in advance in the read only memory (ROM) of the ADF controller 904. In other words, the data includes an inverse matrix R-1 of the correlation matrix of a unit space data set (i.e., the reference data set) used when calculating the Mahalanobis distance and a threshold Th for classifying the calculated Mahalanobis distance into normal conveyance or abnormal conveyance.

The inverse matrix R-1 is obtained by creating a unit space data set (i.e., reference data set) based on a feature obtained from an operating sound in which the original document MS is successfully conveyed in advance. The threshold Th for classifying the calculated Mahalanobis distance into normal conveyance and abnormal conveyance is set by obtaining in advance a Mahalanobis distance at which a false negative rate (erroneous determination rate of normal conveyance) and a false positive rate (erroneous determination rate of abnormal conveyance) are equal to or less than respective target values.

However, in a case where the abnormal conveyance is determined with one set of index data including the inverse matrix R-1 and the threshold Th obtained by one set of unit space data set (i.e., reference data set), it is likely that the accuracy in determination of abnormal conveyance deteriorates. This is because, when two or more original documents MS are being conveyed, the sound collection microphone 201 picks up not only the operating sounds when the original documents MS are conveyed but also the conveyance sound of the preceding original document MS that has passed through the pickup roller 80. For this reason, the operating sounds generated during the normal conveyance with the preceding original document being conveyed and the operation sound during the normal conveyance with no preceding original document being conveyed are greatly different from each other. Due to such a configuration, the variation increases in the unit space data set (i.e., the reference data set) created from the feature obtained from the operating sounds generated in normal conveyance with the preceding original document being conveyed and the feature obtained from the operating sounds at the time of normal conveyance with no preceding original document being conveyed. As a result, the accuracy in the inverse matrix R-1 and the threshold Th obtained based on the unit space data set deteriorates, and the abnormal conveyance cannot be determined with high accuracy. As a result, erroneous determination of normal conveyance or erroneous determination of abnormal conveyance are likely to occur.

In order to address such an inconvenience, in the present embodiment, multiple sets of index data are prepared in advance, and the abnormal conveyance is determined using the optimum index data (i.e., the inverse matrix R-1 and the threshold Th) corresponding to the number of original documents being conveyed as a conveyance condition. A detailed description is now given of the ADF 51 according to the present embodiment, with reference to the drawings.

Figure 7:
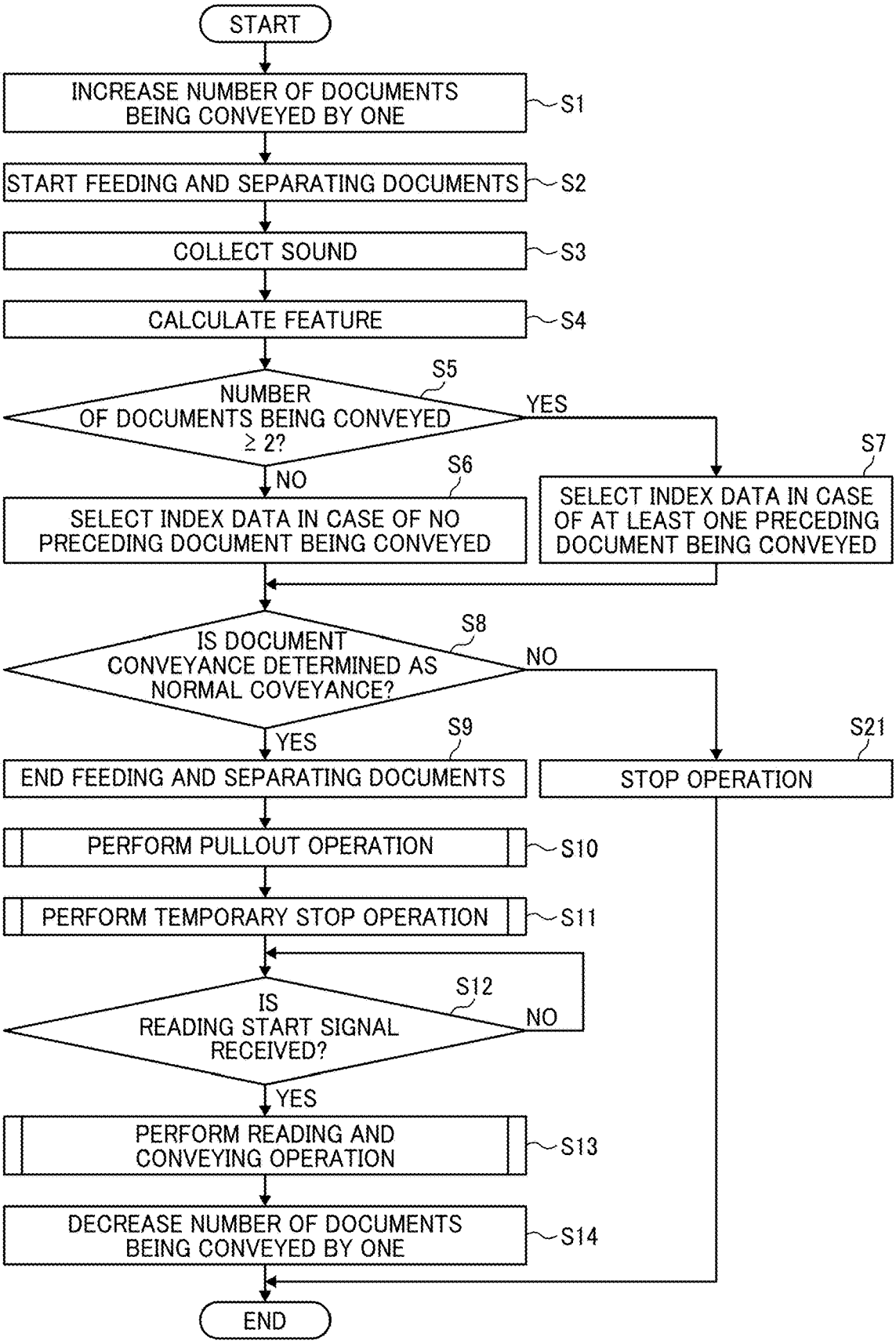
FIG. 7 is a flowchart of an abnormal document conveyance determination process for selecting index data to be used, based on the number of documents being conveyed as a conveyance condition.

FIG. 7 is a flowchart of a document conveyance abnormality determination process for each original document, executed by the ADF controller 904.

In the present embodiment, the sheet feeding operation of the original documents MS is continuously performed with an intervals between adjacent original documents MS to such an extent that the original documents MS as sheets do not overlap with each other in order to increase the throughput of reading. For this reason, multiple original documents MS are simultaneously present with the intervals between adjacent original documents MS in the original document conveyance passage. As a result, the document conveyance abnormality determination process illustrated in the flowchart of FIG. 7 is executed simultaneously in parallel.

When the ADF controller 904 receives a document feeding signal form the apparatus controller 901, the ADF controller 904 sets a counter of the number of original documents being conveyed on the random access memory (RAM) to zero (0). Then, the ADF controller 904 increases (increments) the counter of the "number of original documents being conveyed" by one (1) (step S1), and starts feeding and separating the original documents MS (step S2). For the first original document MS, the count value "0" is incremented by one (1). For the second original document MS following the first original document MS, the count value "1" at the time is incremented by one (1). As will be described below, the "number of original documents being conveyed" is decremented by one (1) with respect to the count value of the "number of original documents being conveyed" at the timing at which the original document MS passes through the document ejection roller pair 94. As a result, the "number of original documents being conveyed" temporarily stored in the RAM of the ADF controller 904 indicates the number of original documents currently being conveyed in the ADF 51.

The ADF controller 904 causes the sound collection microphone 201 to collect operating sounds generated when the original documents MS are conveyed and simultaneously starts the sheet feeding and separating operation (step S3). Then, the ADF controller 904 temporarily stores the sound signals of the operating sounds collected by the sound collection microphone 201, in the RAM of the ADF controller 904.

The ADF controller 904 then calculates the feature of the operating sound stored in the RAM (step S4). Specifically, the short-time Fourier transform (STFT) is performed on the sound signal of the operating sound stored in the RAM to calculate the time sequence of the power spectrum of the sound signal. The ADF controller 904 then perform a characterization process on the time sequence of the calculated power spectrum to calculate the feature of the operating sound. The characterization process may include, for example, time integration of power in a given frequency band and spectral flux between successive frames. In other words, in the present embodiment, the ADF controller 904 serves as a feature extraction unit. The feature that quantitatively describes the feature of the operating sound used for determining the operation condition is not limited to the above-described feature. For example, the feature may include known sound features such as Mel-Frequency Cepstral Coefficients.

When the feature is calculated, the ADF controller 904 determines whether any abnormal conveyance occurs based on the calculated feature. In the present embodiment, the index data (i.e., the inverse matrix R-1 and the threshold Th) used for determining abnormal conveyance is selected based on the number of original documents being conveyed.

More specifically, the ADF controller 904 checks the "number of original documents being conveyed" in the RAM of the ADF controller 904. When the "number of original documents being conveyed" is two or more, in other words, when the preceding original document is being conveyed (YES in step S5), the ADF controller 904 selects a set of index data for the case where at least one preceding original document is being conveyed (step S7). On the other hand, when the "number of original documents being conveyed" is less than two, in other words, when no preceding original document is being conveyed (NO in step S5), the ADF controller 904 selects a set of index data for the case where no preceding original document is being conveyed (step S6). In the present embodiment, the ADF controller 904 serves as an index data selection unit.

The inverse matrix R-1 is one of the index data for the case when a preceding original document is being conveyed, and is obtained from the unit space data set (i.e., the reference data set) created in advance based on the feature of the operating sound generated in normal conveyance when a preceding original document is being conveyed. The threshold Th is one of the index data for the case when a preceding original document is being conveyed, and is set by obtaining in advance a Mahalanobis distance at which the false negative rate and the false positive rate are equal to or less than the respective target values relative to the unit space data set (i.e., the reference data set).

The unit space data set created based on the feature of the operating sound generated in normal conveyance in the case where a preceding original document is being conveyed does not include the feature of the operating sound generated in normal conveyance in the case where no preceding original document is being conveyed. Accordingly, the variation in the unit space data set (i.e., the reference data set) can be reduced, and the inverse matrix R-1 and the threshold Th optimized for determination of abnormal conveyance in a case where a preceding original document is being conveyed can be obtained.

The inverse matrix R-1 is one of the index data for the case when no preceding original document is being conveyed, and is obtained from the unit space data set (i.e., the reference data set) created in advance based on the feature of the operating sound generated in normal conveyance when no preceding document is being conveyed. The threshold Th is one of the index data for the case when no preceding original document is being conveyed, and is set by obtaining in advance a Mahalanobis distance at which the false negative rate and the false positive rate are equal to or less than the respective target values relative to the unit space data set (i.e., the reference data set).

The unit space data set created based on the feature of the operating sound generated in normal conveyance in the case where no preceding original document is being conveyed does not include the feature of the operating sound generated in normal conveyance in the case where a preceding original document is being conveyed. Accordingly, the variation in the unit space data set (i.e., the reference data set) can be reduced, and the inverse matrix R-1 and the threshold Th optimized for determination of abnormal conveyance in a case where no preceding original document is being conveyed can be obtained.

When the abnormal conveyance determination model is selected, the ADF controller 904 determines whether the original document conveyance is normal conveyance by the MT method (step S8). In other words, the ADF controller 904 performs abnormal conveyance determination by the MT method. The determination of whether the original document conveyance is normal conveyance or abnormal conveyance is performed at a timing when the original document MS is conveyed by a given distance from the document set position. Whether the original document MS is conveyed by the given distance is determined using, for example, the number of driving pulses of the sheet feeding motor 191 and the elapsed time from the start of driving of the sheet feeding motor 191.

The "given distance" is preferably set to be shorter than a distance from the leading end of the original document MS placed on the document loading tray 53 to a sheet separation portion (i.e., a separation nip region) where the separation roller 85 is in contact with the sheet feed belt 84. By setting such a distance, the ADF controller 904 can determine abnormal conveyance before the leading end of the original document MS reaches the sheet separation portion. As a result, the conveyance of the original documents MS can be stopped before the leading end of the bundle of original documents MS bound by metal pieces such as staples and clips enter the sheet separation portion, which can reduce occurrence of damage on the original documents MS.

In the abnormal conveyance determination, the ADF controller 904 initially inputs the feature of the sound calculated at the point in time to calculate the Mahalanobis distance using the inverse matrix R-1 corresponding to the selected conveyance condition. The ADF controller 904 then determines whether the calculated Mahalanobis distance is equal to or smaller than the threshold Th corresponding to the conveyance condition. When the calculated Mahalanobis distance is equal to or smaller than the threshold Th, the ADF controller 904 determines that the conveyance is normal conveyance. By contrast, when the calculated Mahalanobis distance is greater than the threshold Th, the ADF controller 904 determines that the conveyance is abnormal conveyance.

In the present embodiment, the abnormal conveyance is determined using the index data (i.e., the inverse matrix R-1 and the threshold Th) according to the conveyance condition of whether a preceding original document is being conveyed. The inverse matrix R-1 and the threshold Th of the index data are created based on the operating sounds generated in normal conveyance under each conveyance condition as described above, and are optimized for the abnormal conveyance determination under each conveyance condition. Accordingly, the abnormal conveyance can be determined with good accuracy and erroneous determination can be reduced well.

When the original document conveyance is determined as normal conveyance (YES in step S8), the ADF controller 904 executes the above-described document conveyance process. In other words, the ADF controller 904 causes the original document MS to be fed and separated from the subsequent original documents MS (step S9). Then, the ADF controller 904 causes the sheet feeding motor 191 to rotate in reverse, so that the pullout drive roller 87 pulls out the original document MS on which skew correction is performed. In other words, the ADF controller 904 performs a document pullout operation on the skew-corrected original document MS (step S10). Then, the ADF controller 904 causes the conveyance of the original document MS to temporarily stop before the first reading and conveying part E. In other words, the ADF controller 904 performs a temporary stop operation for temporarily stopping the conveyance of the original document MS before the original document MS enters the first reading and conveying part E (step S11). After step S11, the ADF controller 904 waits for the reading start signal to be sent from the scanner controller 903, in other words, the ADF controller 904 determines whether the reading start signal sent from the scanner controller 903 is received (step S12). When the reading start signal is not received (NO in step S12), step S12 is repeated until the reading start signal is received. On the other hand, when the reading start signal is received (YES in step S12), the ADF controller 904 resumes conveyance of the original document MS and starts to perform the reading and conveying operation to convey the original document MS sequentially to the first reading and conveying part E, the second reading and conveying part F, and the document ejecting part G (step S13).

In response to the detection of the leading end of the original document MS by the document ejection sensor 61, the ADF controller 904 counts the pulses of the document ejection motor, so that the timing when the trailing end of the original document MS passes through the nip region of the document ejection roller pair 94 is calculated. The ADF controller 904 then causes the sheet ejection clutch 194 to stop based on the calculation result and decreases (decrements) the counter of the "number of original documents being conveyed" by one (step S14).

On the other hand, when the original document conveyance is determined as abnormal conveyance (NO in step S8), the ADF controller 904 causes conveyance of the whole original documents MS being conveyed to be stopped (step S21), and ends the reading operation.

In the above description, the ADF controller 904 grasps the number of original documents being conveyed and selects the index data (i.e., the inverse matrix R-1 and the threshold Th) based on the grasped number of original documents being conveyed. However, the ADF controller 904 may select the index data based on the order of conveyance in the continuous document conveyance. No preceding original document is being conveyed for the original document MS for the first page to be conveyed. However, a preceding original document is being conveyed for the original documents MS for the second and the subsequent pages. For this reason, the sound collection microphone 201 collects the operating sounds generated when the preceding original document is conveyed in addition to the operating sound generated when the original document MS for the second and subsequent pages are conveyed. Accordingly, the index data to be used can be selected based on the order of conveyance in the continuous document conveyance as a conveyance condition.

Even in a device is not affected by the conveyance sound of a preceding original document, for example, that the sound collection microphone 201 hardly collects the conveyance sound of a preceding original document, if the following conveyance control is performed in the continuous document conveyance, the operating sounds of the original document MS for the first page collected by the sound collection microphone 201 may be different from the operating sounds of the original documents MS for the second and subsequent pages collected by the sound collection microphone 201. In other words, when the conveyance control for obtaining the productivity is executed by making the conveyance speed at the feed, separation, and contact portions faster for the original document MS for the first page to be conveyed first. When the conveyance speeds of the original documents MS are different from each other, the frequency characteristics of the operating sounds collected by the sound collection microphone 201 become different from each other. Further, in a case where the operating sounds are obtained until the original document MS is conveyed by a given distance, the operating sounds are obtained at different times. As a result, the operating sounds generated in normal conveyance are different between the original document MS for the first page and the original documents MS for the second and subsequent pages. Due to such a configuration, the variation increases in the unit space data set (i.e., reference data set) created from the feature obtained from the operating sounds generated in normal conveyance with the original document for the first page and the feature obtained from the operating sounds generated in normal conveyance with the original documents for the second and subsequent pages. As a result, as described above, it is likely that the accuracy in the index data including the inverse matrix R-1 and the threshold Th deteriorates, and the abnormal conveyance cannot be determined with good accuracy.

Accordingly, in the continuous document conveyance, even when the ADF controller 904 executes the control to make the conveyance speed in the feed, separation, and contact portions faster only for the original document MS for the first page to be conveyed first, the ADF controller 904 may select the index data to be used based on the order of conveyance in the continuous document conveyance as a conveyance condition. Moreover, the index data to be used may be selected with the conveyance speed and the sheet quality as conveyance conditions.

Figure 8:
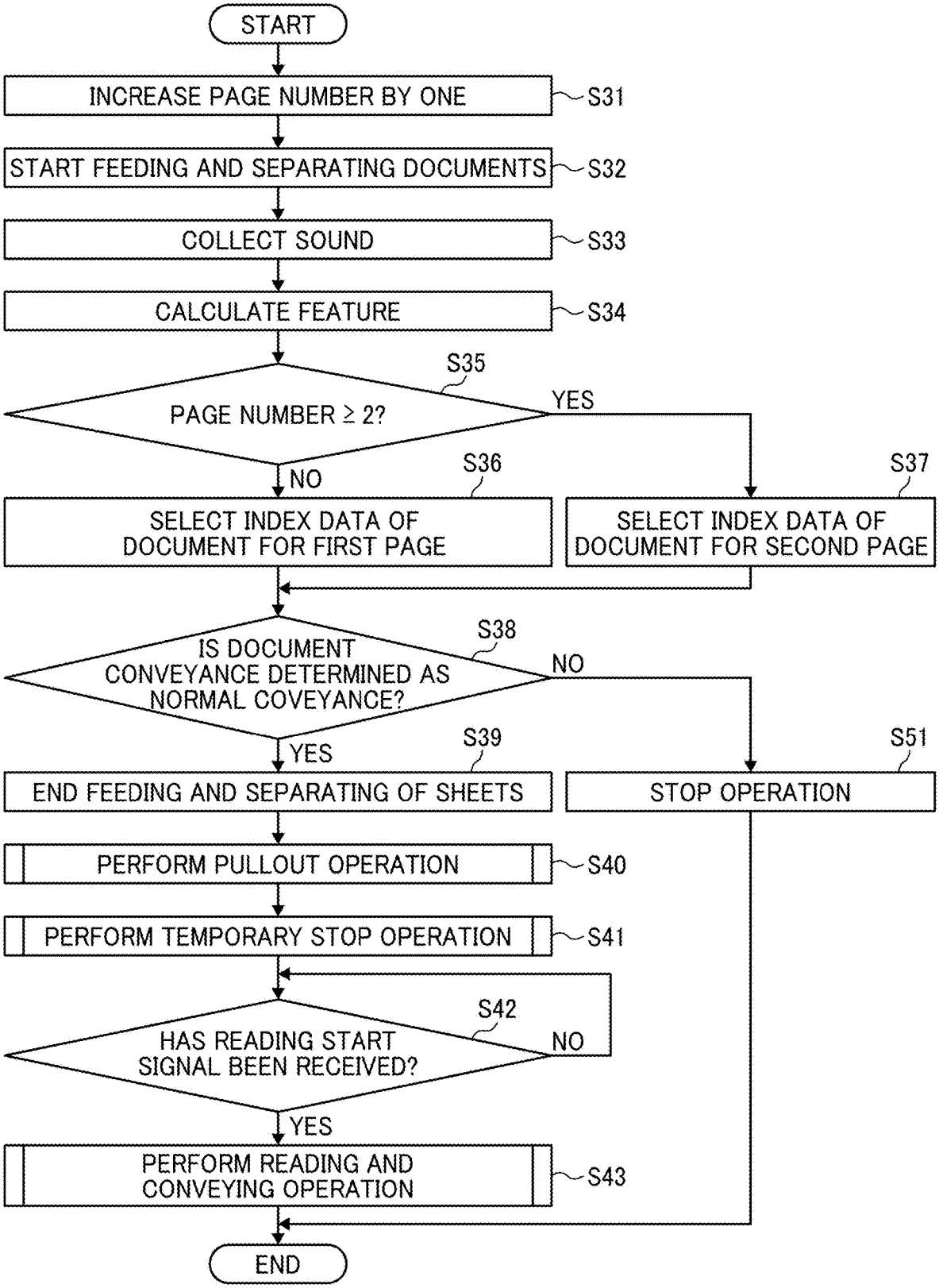
FIG. 8 is a flowchart of an abnormal document conveyance determination process for selecting index data to be used, based on the order of conveyance of continuous documents as a conveyance condition.

FIG. 8 is a flowchart of the document conveyance abnormality determination process for selecting the index data to be used based on the order of conveyance in the continuous document conveyance as a conveyance condition.

In the continuous document conveyance, as described above, as multiple original documents are in the document conveyance passage, the flow illustrated in FIG. 8 is also executed concurrently for each original document to be fed.

Initially, when the ADF controller 904 receives a document feeding signal form the apparatus controller 901, the ADF controller 904 sets the "page number" counter in the RAM of the ADF controller 904 to zero (0). Then, the ADF controller 904 increases (increments) the "page number" counter by one (1) (step S31), and starts feeding and separating the original documents MS (step S32).

As described above, the ADF controller 904 causes the sound collection microphone 201 to collect the operating sound generated when the original documents MS are conveyed (step S33), and calculates the feature of the operating sound (step S34). The ADF controller 904 then checks the "page number" counter in the RAM of the ADF controller 904. Specifically, the ADF controller 904 determines whether the page number is two (2) or smaller (step S35). When the "page number" is "1" (NO in step S35), the ADF controller 904 selects the index data of the original document for the first page (step S36). On the other hand, when the "page number" is equal to or greater than "2" (YES in step S35), the ADF controller 904 selects the index data of the original document for the second and subsequent pages (step S37).

The index data (including the inverse matrix R-1 and the threshold Th) for the original document for the first page is obtained from the unit space data set (i.e., the reference data set) created in advance from the feature of the operating sound generated in normal conveyance of the original document MS for the first page. The unit space data set does not include the feature of the operating sounds generated in normal conveyance of the original documents for the second and subsequent pages having different frequency from the operating sound at the conveyance of the original document for the first page. Accordingly, the variation in the unit space data set (i.e., the reference data set) can be reduced, and the index data (including the inverse matrix R-1 and the threshold Th) optimized for conveyance of the original document for the first page can be obtained from the unit space data set (i.e., the reference data set).

The index data for the original documents for the second and subsequent pages is obtained from the unit space data set (i.e., the reference data set) created in advance from the feature of the operating sounds generated in normal conveyance of the original document MS for the second and subsequent pages. The unit space data set does not include the feature of the operating sound generated in normal conveyance of the original document for the first page having a different frequency from the operating sounds generated in conveyance of the original documents for the second and subsequent pages. Accordingly, the variation in the unit space data set (i.e., the reference data set) can be reduced, and the index data (including the inverse matrix R-1 and the threshold Th) optimized for abnormal conveyance determination of the original documents MS for the second and subsequent pages can be obtained from the unit space data set (i.e., the reference data set).

The ADF controller 904 then determines whether the original document conveyance is normal conveyance by the MT method based on the feature of the operating sound calculated to the point in time and the index data corresponding to the selected conveyance condition (step S38). In other words, the ADF controller 904 performs abnormal conveyance determination by the MT method based on the feature of the operating sound calculated to the point in time and the index data corresponding to the selected conveyance condition.

To be more specific, as described above, the ADF controller 904 inputs the feature of the operating sound calculated at the point in time to calculate the Mahalanobis distance using the inverse matrix R-1 corresponding to the selected conveyance condition. The ADF controller 904 then determines the conveyance is normal conveyance when the calculated Mahalanobis distance is equal to or smaller than the threshold Th corresponding to the conveyance condition (YES in step S38). By contrast, the ADF controller 904 determines the conveyance is abnormal conveyance when the calculated Mahalanobis distance is greater than the threshold Th NO in step S38).

When the ADF controller 904 determines that the document conveyance is normal conveyance (YES in step S38), the ADF controller 904 executes the document conveyance process in steps S39 to S43 corresponding to steps S9 to S13 described above. On the other hand, the ADF controller 904 determines that the document conveyance is abnormal conveyance (NO in step S38), the ADF controller 904 causes conveyance of the whole original documents MS being conveyed to be stopped (step S51), and ends the reading operation.

As described above, the flow of FIG. 8 includes the index data (including the inverse matrix R-1 and the threshold Th) optimized for the abnormal conveyance determination on conveyance of the original document MS for the first page and the index data (including the inverse matrix R-1 and the threshold Th) optimized for the abnormal conveyance determination on conveyance of the original document MS for the second and subsequent pages. Accordingly, the ADF controller 904 selects the index data corresponding to the order of conveyance as the conveyance condition, and performs the abnormal conveyance determination using the selected index data. Thus, the abnormal conveyance can be determined with good accuracy on the original document for the first page and the original documents for the second and subsequent pages.

Further, as described above, the ADF 51 according to the present embodiment includes a thin paper mode for reading image data on thin papers and a mixed document mode for mixed stacking and conveyance of original documents MS having different sizes. In the thin paper mode or the mixed document mode, the original document MS is conveyed at a conveyance speed of the original document MS totally slower than the normal reading mode. When the conveyance speeds of the original documents MS are different from each other, the frequency characteristics of the operating sound and the times of the operating sound become different from each other. For this reason, the variation increases in the unit space data set (i.e., the reference data set) created from the feature obtained from the operating sound generated in normal conveyance with the document conveyance speeds different from each other. Due to such a configuration as described above, it is likely that the accuracy in the index data including the inverse matrix R-1 and the threshold Th deteriorates, and the abnormal conveyance cannot be determined with good accuracy.

In order to address this inconvenience, multiple index data according to the document conveyance speed as a conveyance condition may be stored in the ROM of the ADF controller 904, and the index data used for the abnormal conveyance determination may be selected based on the document conveyance speed. In the present embodiment, the document conveyance speed is set to a conveyance speed at which the original document passes through the sheet separation portion (i.e., the contact portion between the separation roller 85 and the sheet feed belt 84). However, this setting is an example. For example, the document conveyance speed may be an average document conveyance speed form the start of feeding the original document MS by the pickup roller 80 to arrival of the original document MS to sheet separation portion.

Figure 9:
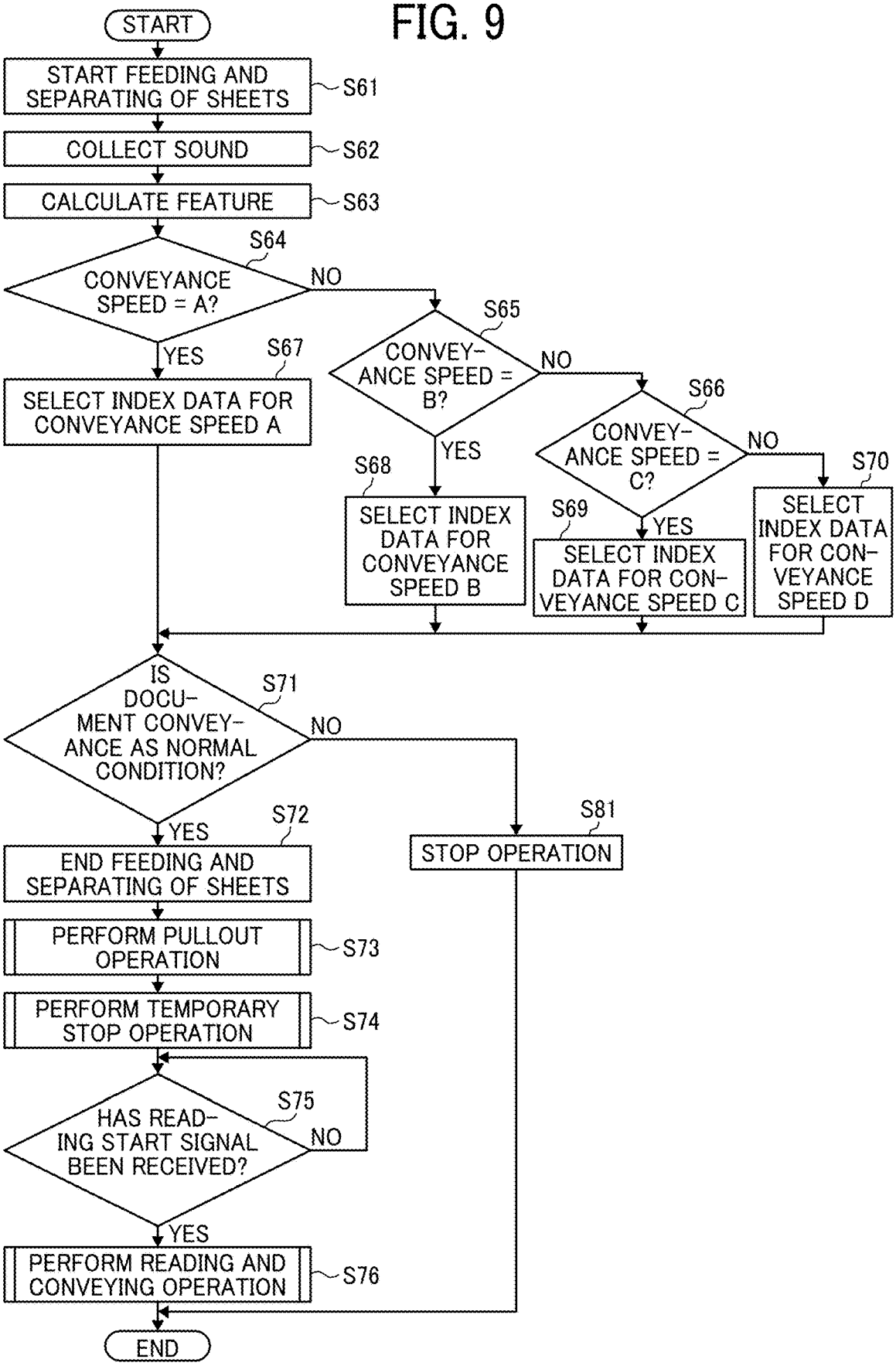
FIG. 9 is a flowchart of an abnormal document conveyance determination process for selecting index data to be used, based on a document conveyance speed as a conveyance condition.

FIG. 9 is a flowchart of an abnormal document conveyance determination process for selecting index data to be used, based on a document conveyance speed as a conveyance condition.

As the copy start button 158 is pressed by an operator, the document feeding signal is sent from the apparatus controller 901 to the ADF controller 904. At the same time, the apparatus controller 901 notifies the ADF controller 904 of the setting information such as the thin paper mode for reading thin papers and mixed document mode. The ADF controller 904 comprehensively determines the conveyance speed of the original document MS from, for example, the setting information sent from the apparatus controller 901.

The, the ADF controller 904 starts the feeding and separating operation at the determined conveyance speed (step S61). At the same time, the ADF controller 904 causes the sound collection microphone 201 to collect the operating sound generated when the original document MS is conveyed (step S62) to calculate the feature of the operating sound (step S63). The ADF controller 904 then determines whether the conveyance speed is a conveyance speed A (step S64).

When the conveyance speed is not the conveyance speed A (NO in step S64), the ADF controller 904 determines whether the conveyance speed is a conveyance speed B (step S65). When the conveyance speed is not the conveyance speed B (NO in step S65), the ADF controller 904 determines whether the conveyance speed is a conveyance speed C (step S66). When the conveyance speed is not the conveyance speed C (NO in step S66), the ADF controller 904 selects the index data for a conveyance speed D (step S70), and proceeds to step S71.

When the ADF controller 904 determines that the conveyance speed is the conveyance speed A (YES in step S64), the conveyance speed B (YES in step S65), or the conveyance speed C (YES in step S66), the ADF controller 904 also proceeds to step S71. In FIG. 9, there are four document conveyance speeds A, B, C, and D set by, for example, the reading mode, and index data in accordance with each document conveyance speed is stored in the ROM of the ADF controller 904. The index data includes the inverse matrix R-1 and the threshold Th obtained from the unit space data set (i.e., the reference data set) based on the feature of the operating sound generated in normal conveyance at the corresponding conveyance speed. The inverse matrix R-1 and the threshold Th can be obtained from the unit space data set (i.e., the reference data set) having less variation. Accordingly, the inverse matrix R-1 and the threshold Th optimized for the abnormal conveyance determination on the original document MS conveyed at the corresponding conveyance speed can be used.

The ADF controller 904 then determines whether the original document conveyance is normal conveyance by the MT method based on the feature of the operating sound calculated to the point in time and the index data corresponding to the selected conveyance speed (step S71). In other words, the ADF controller 904 performs abnormal conveyance determination by the MT method based on the feature of the operating sound calculated to the point in time and the index data corresponding to the selected conveyance speed.

To be more specific, the ADF controller 904 inputs the feature of the calculated operating sound to calculate the Mahalanobis distance using the inverse matrix R-1 of the index data corresponding to the selected conveyance speed. The ADF controller 904 then determines the conveyance is normal conveyance when the calculated Mahalanobis distance is equal to or smaller than the threshold Th corresponding to the conveyance condition (YES in step S71). By contrast, the ADF controller 904 determines the conveyance is abnormal conveyance when the calculated Mahalanobis distance is greater than the threshold Th NO in step S71).

As described above, when the ADF controller 904 determines that the document conveyance is normal conveyance (YES in step S71), the ADF controller 904 executes the document conveyance process in steps S72 to S76 corresponding to steps S9 to S13 in the flowchart of FIG. 7 described above. On the other hand, the ADF controller 904 determines that the document conveyance is abnormal conveyance (NO in step S71), the ADF controller 904 causes conveyance of the whole original documents MS being conveyed to be stopped (step S81), and ends the reading operation.

In the flow illustrated in FIG. 9, the abnormal conveyance determination can be performed using the index data including the inverse matrix R-1 and the threshold Th optimized for each conveyance speed as a conveyance condition, and abnormal conveyance can be determined with good accuracy.

For example, four sets of index data corresponding to each conveyance speed in a case where a preceding original document is being conveyed and four sets of index data corresponding to each conveyance speed in a case where no preceding original document is being conveyed. Then, corresponding index data may be selected based on whether any preceding original document is being conveyed and the determined conveyance speed. By so doing, a further accurate abnormal conveyance determination can be performed.

In the present embodiment, the abnormal conveyance determination is executed using the MT method. However, the abnormal conveyance determination may be executed by classifying the features of the operating sounds into normal conveyance and abnormal conveyance through machine learning of, for example, support-vector machines. In this case, multiple learned models according to the conveyance condition are stored as the index data, to the ROM of the ADF controller 904. Each of the learned models is obtained as a result of machine learning based on the features of the operating sounds generated when the original documents MS are conveyed under the corresponding conveyance conditions and the correct data (normal conveyance or abnormal conveyance), and is optimized for the corresponding conveyance condition.

The ADF controller 904 selects a learned model according to the conveyance condition, classifies the features of the operating sounds into normal conveyance or abnormal conveyance using the selected learned model, and performs the abnormal conveyance determination.

Also in such a configuration, the ADF controller 904 can determine the abnormal conveyance with good accuracy by using the learned models optimized for the conveyance condition.

In the embodiments described above, the ADF 51 is described as a sheet conveying device that is applicable to the present disclosure. However, the configuration is not limited to the above-described configurations. For example, the present disclosure may be applied to a printer serving as a sheet conveying device that conveys a transfer sheet on which an image forming operation is performed in the image forming device 1 or to an inkjet copier serving as an image forming apparatus.

The above-described embodiments are limited examples, and the present disclosure includes, for example, the following aspects having advantageous effects.

Aspect 1

In Aspect 1, a sheet conveying device includes a conveyor (for example, the pickup roller 80), a sound collector (for example, the sound collection microphone 201), and circuitry (for example, the ADF controller 904). The conveyor conveys a sheet. The sound collector collects operating sounds generated when the sheet is conveyed. The circuitry is to extract a feature of the operating sound collected by the sound collector, determine whether a conveyance of the sheet is an abnormal conveyance based on the feature, select, among multiple sets of index data serving as index to determine whether the abnormal conveyance occurs, a set of index data (for example, the inverse matrix R-1, the threshold Th) corresponding to a conveyance condition of the sheet, and determine whether the abnormal conveyance occurs using the selected set of index data.

According to this configuration, the ADF controller 904 determines, using the index data corresponding to the sheet conveyance condition, whether abnormal conveyance of the sheet occurs. Accordingly, the ADF 51 can perform the abnormal conveyance determination with high accuracy, and can prevent erroneous determination.

Aspect 2

In Aspect 2, according to Aspect 1, the conveyance condition of the sheet is a number of sheets being conveyed other than a sheet that is an object of an abnormal conveyance determination.

According to this configuration, as described with reference to FIG. 7, the ADF controller 904 determines whether abnormal conveyance of the sheet occurs, using the optimum index data corresponding to the number of sheets being conveyed other than a sheet that is an object of an abnormal conveyance determination. Accordingly, the ADF 51 can perform the abnormal conveyance determination with good accuracy.

Aspect 3

In Aspect 3, according to Aspect 2, the conveyance condition of the sheet is whether a sheet being conveyed other than a sheet that is an object of an abnormal conveyance determination.

According to this configuration, as described in the embodiments above, the sound collector such as the sound collection microphone 201 collects the operating sounds of the sheet being conveyed other than a sheet that is an object of an abnormal conveyance determination. By so doing, the operating sounds generated in normal conveyance differs depending on whether a sheet other than a sheet that is an object of an abnormal conveyance determination is being conveyed. As a result, the ADF controller 904 changes the index data to be used for the abnormal conveyance determination depending on whether any sheet other than a sheet that is an object of an abnormal conveyance determination is being conveyed. By so doing, the ADF 51 can perform the abnormal conveyance determination with good accuracy.

Aspect 4

In Aspect 4, according to Aspect 1, the conveyance condition of the sheet is an order of conveyance of sheets that are objects of an abnormal conveyance determination in a continuous sheet conveying operation.

According to this configuration, as described with reference to FIG. 8, the ADF controller 904 determines whether abnormal conveyance of the sheet occurs, using the optimum index data corresponding to the order of conveyance of the sheet. Accordingly, the ADF 51 can perform the abnormal conveyance determination with good accuracy.

Aspect 5

In Aspect 5, according to Aspect 4, a conveyance speed of a first sheet of the sheets is faster than a conveyance speed of a second sheet of the sheet in the continuous sheet conveying operation, and the conveyance condition of the sheet is whether the sheet is the first sheet of the sheets in the continuous sheet conveying operation.

According to this configuration, as described in the embodiments above, the operating sounds generated in normal conveyance of the first sheet that is initially conveyed and has the conveyance speed faster than the conveyance speed of the second and subsequent sheets is different from the operating sounds generated in normal conveyance of the second and subsequent sheets. Accordingly, the ADF controller 904 changes the index data used for the abnormal conveyance determination depending on whether the sheet is the first sheet that is initially conveyed in the continuous sheet conveying operation. By so doing, the ADF 51 can perform the abnormal conveyance determination with good accuracy.

Aspect 6

In Aspect 6, according to any one of Aspect 1 to 5, the conveyance condition of the sheet is a conveyance speed of the sheet.

According to this configuration, as described with reference to FIG. 9, abnormal conveyance can be determined using the optimum index data in accordance with the conveyance speed of a sheet.

Aspect 7

In Aspect 7, according to any one of Aspects 1 to 6, the circuitry (for example, the ADF controller 904 as an abnormal conveyance determination unit) is to stop a sheet conveying operation in response to a determination of occurrence of an abnormal conveyance. According to this configuration, as described in the embodiments above, the conveyance of the sheet such as the original document MS can be stopped before a paper jam occurs, and any damage on a sheet can be prevented.

Aspect 8

In Aspect 8, the sheet conveying device according to any one of Aspects 1 to 7 further includes a sheet tray (for example, the movable document table 54) on which the sheet is stacked, and a sheet feed roller (for example, the pickup roller 80) to feed the sheet stacked on the sheet tray. The operation sound is operation sound of the sheet feed roller. According to this configuration, as described in the embodiments above, the ADF controller 904 serving as an abnormal conveyance determination unit can determine whether abnormal conveyance occurs, before the sheet is conveyed to the sheet separation portion. Accordingly, the ADF 51 can prevent the sheets from being damaged by being tom or wrinkled even if the bundle of sheets bound by staples is conveyed to the sheet separation portion, and can protect the sheet.

Aspect 9

In Aspect 9, the sheet conveying device according to any one of Aspects 1 to 8 further includes a sheet tray (for example, the movable document table 54) on which the sheet is stacked. The operating sound is a conveyance sound that is generated when the sheet is conveyed.

According to this configuration, as described in the embodiments above, the ADF controller 904 serving as an abnormal conveyance determination unit can determine whether abnormal conveyance occurs, before the sheet is conveyed to the sheet separation portion. Accordingly, the ADF 51 can prevent the sheets from being damaged by being tom or wrinkled even if the bundle of sheets bound by staples is conveyed to the sheet separation portion, and can protect the sheet.

Aspect 10

In Aspect 10, an image forming apparatus (for example, the copier 500) includes the sheet conveying device (for example, the ADF 51) according to any one of Aspects 1 to 9, a sheet feeder (for example, the blank sheet feeding device 40), and an image former (for example, the image forming device 1). The sheet conveying device convey an original document (for example, the original document MS). The sheet feeder feeds a blank sheet. The image former forms an image based on image data of the original document, on the blank sheet fed by the sheet feeder.

According to this configuration, the sheet such as the original document can be prevented from a paper jam or from being damaged, for example, being bent, wrinkled, or tom.

Aspect 11

In Aspect 11, an automatic document feeder (for example, the ADF 51) includes the sheet conveying device (for example, the ADF 51) and an image reader (for example, the scanner 150). The sheet conveying device conveys an original document (for example, the original document MS). The image reader reads image data of the original document conveyed from the sheet conveying device.

According to this configuration, damage on a sheet or damage on an original document can be forestalled.

Aspect 12

In Aspect 12, a sheet conveying device (for example, the ADF 51) includes a conveyor (for example, the pickup roller 80), a sound collector (for example, the sound collection microphone 201), and circuitry (for example, the ADF controller 904). The conveyor conveys a sheet. The sound collector collects operating sounds generated when the sheet is conveyed. The circuitry is to extract a feature amount of the operating sound collected by the sound collector, select, among multiple sets of index data serving as index to determine whether an abnormal conveyance of the sheet is to be occurred, a set of index data corresponding to a conveyance condition of the sheet, and determine whether the abnormal conveyance of the sheet is to be occurred based on the feature amount and the set of index data selected from the multiple sets of index data.

Aspect 13

In Aspect 13, according to Aspect 12, the conveyance condition of the sheet is a number of sheets being conveyed other than an object sheet that is an object to be determined the abnormal conveyance.

Aspect 14

In Aspect 14, according to Aspect 13, the conveyance condition of the sheet is whether there is a sheet being conveyed other than the object sheet.

Aspect 15

In Aspect 15, according to Aspect 12, the conveyance condition of the sheet is an order of conveyance of sheets that are objects to be determined the abnormal conveyance in the conveyance of sheets continuously conveyed.

Aspect 16

In Aspect 16, according to Aspect 15, a conveyance speed of a first sheet of the sheets is faster than a conveyance speed of a second sheet of the sheets in the conveyance of sheets continuously conveyed, and the conveyance condition of the sheets is whether the sheet is the first sheet of the sheets in the conveyance of sheets continuously conveyed.

Aspect 17

In Aspect 17, according to Aspect 12, the conveyance condition of the sheet is a conveyance speed of the sheet.

Aspect 18

In Aspect 18, according to Aspect 12, the circuitry is further configured to stop conveying the sheet in response to a determination of occurrence of the abnormal conveyance.

Aspect 19

In Aspect 19, the sheet conveying device according to Aspect 12 further includes a sheet tray (for example, the movable document table 54) on which the sheet is stacked, and a sheet feed roller (for example, the pickup roller 80) to feed the sheet stacked on the sheet tray. The operating sound is an operating sound of the sheet feed roller.

Aspect 20

In Aspect 20, the sheet conveying device according to Aspect 12 further includes a sheet tray (for example, the movable document table 54) on which the sheet is stacked. The operating sound is conveyance sound that occurs when the sheet stacked on the sheet tray is fed.

Aspect 21

In Aspect 21, an image forming apparatus (for example, the copier 500) includes the sheet conveying device (for example, the ADF 51) according to any one of Aspects 12 to 20, a sheet feeder (for example, the blank sheet feeding device 40), and an image former (for example, the image forming device 1). The sheet conveying device automatically conveys an original document (for example, the original document MS). The sheet feeder feeds a blank sheet. The image former forms an image, based on image data of the original document, on the blank sheet fed by the sheet feeder.

Aspect 22

In Aspect 22, an automatic document feeder (for example, the ADF 51) includes the sheet conveying device (for example, the ADF 51) and an image reader (for example, the scanner 150). The sheet conveying device automatically conveys an original document (for example, the original document MS). The image reader reads image data of the original document conveyed from the sheet conveying device.

Aspect 23

In Aspect 23, an image forming apparatus (for example, the copier 500) includes the automatic document feeder (for example, the ADF 51), a sheet feeder (for example, the blank sheet feeding device 40), and an image former (for example, the image forming device 1). The sheet conveying device convey an original document (for example, the original document MS). The sheet feeder feeds a blank sheet. The image former forms an image, based on image data of the original document, on the blank sheet fed by the sheet feeder.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet conveying device comprising:

a conveyor to convey a sheet;

a sound collector to collect an operating sound when the sheet is conveyed; and circuitry configured to:

extract a feature amount of the operating sound collected by the sound collector;

select, among multiple sets of index data serving as index to determine whether an abnormal conveyance of the sheet is to be occurred, a set of index data corresponding to a conveyance condition of the sheet; and determine whether the abnormal conveyance of the sheet is to be occurred based on the feature amount and the set of index data selected from the multiple sets of index data, wherein the conveyance condition of the sheet is a number of sheets being conveyed other than an object sheet that is an object to be determined the abnormal conveyance.

2. The sheet conveying device according to claim 1, wherein:

the conveyance condition of the sheet is whether there is a sheet being conveyed other than the object sheet.

3. The sheet conveying device according to claim 1, wherein;

the circuitry is further configured to stop conveying the sheet in response to a determination of occurrence of the abnormal conveyance.

4. The sheet conveying device according to claim 1, further comprising:

a sheet tray on which the sheet is stacked; and a sheet feed roller to feed the sheet stacked on the sheet tray, wherein the operating sound is an operating sound of the sheet feed roller.

5. The sheet conveying device according to claim 1, further comprising:

a sheet tray on which the sheet is stacked, wherein the operating sound is conveyance sound that occurs when the sheet stacked on the sheet tray is fed.

6. An image forming apparatus comprising:

the sheet conveying device according to claim 1 to automatically convey an original document;

a sheet feeder to feed a blank sheet; and an image former to form an image, based on image data of the original document, on the blank sheet fed by the sheet feeder.

7. An automatic document feeder comprising:

the sheet conveying device according to claim 1 to automatically convey an original document; and an image reader to read image data in the original document conveyed by the sheet conveying device.

8. A sheet conveying device, comprising:

a conveyor to convey a sheet;

a sound collector to collect an operating sound when the sheet is conveyed; and circuitry configured to:

extract a feature amount of the operating sound collected by the sound collector;

select, among multiple sets of index data serving as index to determine whether an abnormal conveyance of the sheet is to be occurred, a set of index data corresponding to a conveyance condition of the sheet; and determine whether the abnormal conveyance of the sheet is to be occurred based on the feature amount and the set of index data selected from the multiple sets of index data, wherein the conveyance condition of the sheet is an order of conveyance of sheets that are objects to be determined the abnormal conveyance in the conveyance of sheets continuously conveyed.

9. The sheet conveying device according to claim 8, wherein:

a conveyance speed of a first sheet of the sheets is faster than a conveyance speed of a second sheet of the sheets in the conveyance of sheets continuously conveyed, and the conveyance condition of the sheets is whether the sheet is the first sheet of the sheets in the conveyance of sheets continuously conveyed.

10. The sheet conveying device according to claim 8, wherein:

the circuitry is further configured to stop conveying the sheet in response to a determination of occurrence of the abnormal conveyance.

11. The sheet conveying device according to claim 8, further comprising:

a sheet tray on which the sheet is stacked; and a sheet feed roller to feed the sheet stacked on the sheet tray, wherein the operating sound is an operating sound of the sheet feed roller.

12. The sheet conveying device according to claim 8, further comprising:

a sheet tray on which the sheet is stacked, wherein the operating sound is conveyance sound that occurs when the sheet stacked on the sheet tray is fed.

13. An image forming apparatus comprising:

the sheet conveying device according to claim 8 to automatically convey an original document;

a sheet feeder to feed a blank sheet; and an image former to form an image, based on image data of the original document, on the blank sheet fed by the sheet feeder.

14. An automatic document feeder comprising:

the sheet conveying device according to claim 8 to automatically convey an original document; and an image reader to read image data in the original document conveyed by the sheet conveying device.

15. A sheet conveying device, comprising:

a conveyor to convey a sheet;

a sound collector to collect an operating sound when the sheet is conveyed; and circuitry configured to:

extract a feature amount of the operating sound collected by the sound collector;

select, among multiple sets of index data serving as index to determine whether an abnormal conveyance of the sheet is to be occurred, a set of index data corresponding to a conveyance condition of the sheet; and determine whether the abnormal conveyance of the sheet is to be occurred based on the feature amount and the set of index data selected from the multiple sets of index data, wherein the conveyance condition of the sheet is a conveyance speed of the sheet.

16. The sheet conveying device according to claim 15, wherein:

the circuitry is further configured to stop conveying the sheet in response to a determination of occurrence of the abnormal conveyance.

17. The sheet conveying device according to claim 15, further comprising:

a sheet tray on which the sheet is stacked, wherein the operating sound is conveyance sound that occurs when the sheet stacked on the sheet tray is fed.

18. The sheet conveying device according to claim 15, further comprising:

a sheet tray on which the sheet is stacked; and a sheet feed roller to feed the sheet stacked on the sheet tray, wherein the operating sound is an operating sound of the sheet feed roller.

19. An image forming apparatus comprising:

the sheet conveying device according to claim 15 to automatically convey an original document;

a sheet feeder to feed a blank sheet; and an image former to form an image, based on image data of the original document, on the blank sheet fed by the sheet feeder.

20. An automatic document feeder comprising:

the sheet conveying device according to claim 15 to automatically convey an original document; and an image reader to read image data in the original document conveyed by the sheet conveying device.

* * * * *